US011180334B2

(12) United States Patent
Matsumoto

(10) Patent No.: US 11,180,334 B2
(45) Date of Patent: Nov. 23, 2021

(54) MEDIUM PROCESSING DEVICE

(71) Applicant: Oki Electric Industry Co., Ltd., Tokyo (JP)

(72) Inventor: Jun Matsumoto, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 169 days.

(21) Appl. No.: 16/674,517

(22) Filed: Nov. 5, 2019

(65) Prior Publication Data

US 2020/0062523 A1 Feb. 27, 2020

Related U.S. Application Data

(63) Continuation of application No. PCT/JP2018/014971, filed on Apr. 9, 2018.

(30) Foreign Application Priority Data

May 9, 2017 (JP) ..... JP2017-093243

(51) Int. Cl.
*B65H 9/16* (2006.01)
*B65H 5/06* (2006.01)

(52) U.S. Cl.
CPC ..... *B65H 9/166* (2013.01); *B65H 5/062* (2013.01); *B65H 2404/14212* (2013.01); *B65H 2511/216* (2013.01); *B65H 2511/242* (2013.01); *B65H 2701/1912* (2013.01)

(58) Field of Classification Search
CPC ..... B65H 9/166; B65H 9/16; B65H 5/062; B65H 2511/242; B65H 2511/216
See application file for complete search history.

(56) References Cited

U.S. PATENT DOCUMENTS 8,113,511 B2 * 2/2012 Kallin ..... B65H 9/166 271/228
8,789,828 B2 * 7/2014 Wang ..... B65H 9/106 271/251
9,751,708 B2 * 9/2017 Hagihara ..... B65H 5/064

FOREIGN PATENT DOCUMENTS

JP S6387474 A 4/1988
JP H0543092 A 2/1993
JP H05330702 A 12/1993
JP 2003146489 A 5/2003
JP 2008239295 A 10/2008

* cited by examiner

*Primary Examiner* — Patrick Cicchino
(74) *Attorney, Agent, or Firm* — Rabin & Berdo, P.C.

(57) ABSTRACT

A medium processing device includes a conveyance guide that forms a conveyance path, a reference surface guide that is provided at one side of the conveyance path, a trigger sensor that detects a rear end of the medium in the conveyance direction, a first alignment roller and a second alignment roller for aligning the medium with the reference surface guide. The first alignment roller is provided at the middle, in a width of the conveyance path. The second alignment roller is provided between the reference surface guide and the first alignment roller in the width direction. The second alignment roller is provided at a downstream side of the first alignment roller in the conveyance direction. A space from the first alignment roller to the second alignment roller in the conveyance direction is longer than a space from the trigger sensor to the first alignment roller in the conveyance direction.

12 Claims, 9 Drawing Sheets

MEDIUM PROCESSING DEVICE

CROSS REFERENCE TO RELATED APPLICATIONS

The application claims priority under 35 USC 119 to Japanese Patent Application No. 2017-093243, filed on May 9, 2017, the disclosure of which is incorporated in its entirety by reference herein.

TECHNICAL FIELD

The present disclosure relates to a medium processing device, and is suitably applied, for example, to a pay-in device are inserted in which media, such as checks, banknotes, or securities.

BACKGROUND ART

Medium processing devices are known in which a technology by which various sized media are inserted in an unaligned state and are aligned with a reference surface side by an alignment roller disposed to incline to a reference side direction with respect to a conveyance direction (see, for example, U.S. Pat. No. 8,113,511).

However, when various sized media are inserted in an inclined state (a skewed state) with respect to the conveyance direction, there is a possibility that portions of the media abutting a reference surface are buckled, causing the media to be moved near the reference surface, and the media could not be aligned along the reference surface, depending on a size, an inserted angle or a position of the media.

The present disclosure describes a medium processing device heavy improved reliability.

SUMMARY OF THE INVENTION

A medium processing device according to an exemplary embodiment of the present disclosure, includes a conveyance guide, a reference surface guide, a trigger sensor, a first alignment roller, and a second alignment roller. The conveyance guide forms a conveyance path through which a medium is conveyable, and guides the medium along the conveyance path in a conveyance direction. The reference surface guide is provided at one side of the conveyance path, and limits a conveyance range of the conveyance path in a width direction which is orthogonal to the conveyance direction of the medium. The trigger sensor detects a rear end of the medium in the conveyance direction. The first alignment roller and the second alignment roller are provided to align the medium with the reference surface guide. Each of the first and second alignment rollers is disposed so that an axis direction that extends along a rotation axis thereof is inclined with respect to the conveyance direction. The first alignment roller is provided at the middle, in the conveyance path. The second alignment roller is provided between the reference surface guide and the first alignment roller in the width direction. The second alignment roller is provided at a downstream side of the first alignment roller in the conveyance direction. A space from the first alignment roller to the second alignment roller in the conveyance direction is longer than a space from the trigger sensor to the first alignment roller in the conveyance direction.

DESCRIPTION OF EMBODIMENTS

Explanation follows regarding exemplary embodiments to implement the invention (referred to below as "exemplary embodiments"), with reference to the drawings.

1. First Exemplary Embodiment

1-1. Configuration of Check Processing Device

Figure 1:
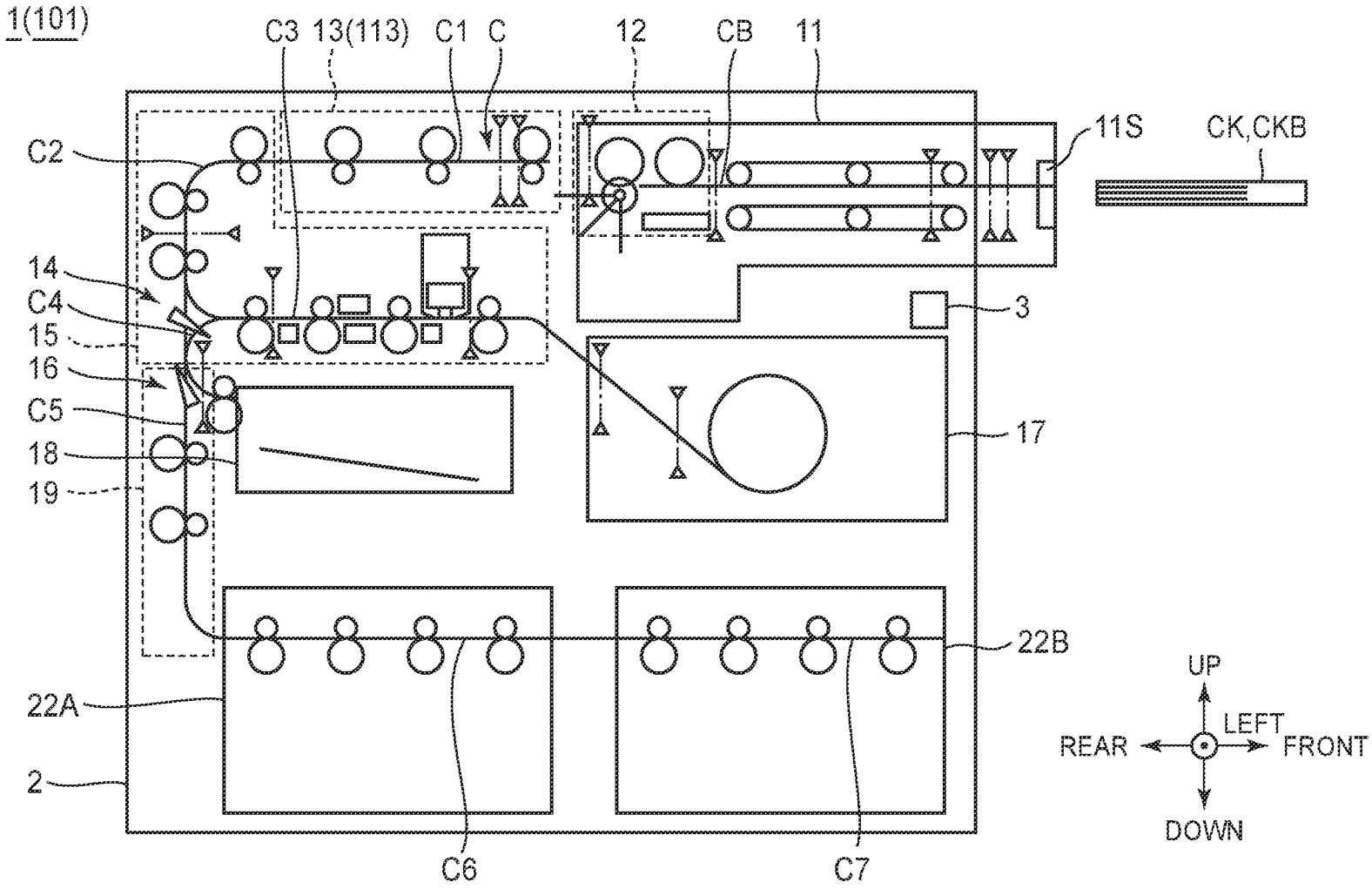
FIG. 1 is a left side view illustrating a configuration example of a check processing device.

As illustrated FIG. 1, a check processing device 1 is installed, for example, in a financial institution or the like, and performs various transactions related to checks. The check processing device 1 is disposed in a casing of a check accepting apparatus performing transactions related to checks such as pay-in processing with a user (that is, a customer of the financial institution). The check processing device 1 incorporates a plurality of processing units that perform various processing related to checks in casing 2 that is formed in an overall rectangular block shape. Hereinafter, the front side is defined as the side of the check processing device 1 that a customer faces, and the opposite side thereto is defined as the rear side. The left side, right side, upper side and lower side are respectively defined from the perspective of the left and right as seen by a customer facing the front side.

The casing 2 is provided with a controller 3 that controls the check processing device 1, a bundle unit 11 that distributes checks to and receives checks from the user, a conveyance path C that conveys checks to each unit, an aligner unit 13 that moves checks near a predetermined reference surface, a scanner unit 15 that reads images and magnetic information of checks and prints transaction information, an escrow unit 17 that stores checks temporarily, a retract unit 18 that stores checks that the user has left in the bundle unit 11, and two stackers 22 (a stacker 22A and a stacker 22B) that store checks used by the user. Moreover, the casing 2 is provided with a frame that supports the bundle unit 11, the aligner unit 13, scanner unit 15, the escrow unit 17, the retract unit 18, and the stackers 22.

The controller 3 performs general control of the overall check processing device 1. The controller 3 is mainly configured by a Central Processing Unit (CPU). The controller 3 reads and executes predetermined programs from Read Only Memory (ROM), flash memory, or the like, to perform various processing such as the pay-in transaction. The controller 3 is provided with an internal storage section including Random Access Memory (RAM), a hard disk drive, flash memory, or the like. The storage section stores various information related to various programs and pay-in transaction. The controller 3 monitors each sensor provided in the casing 2, drives each actuator, performs various decisions, and communicates with a main controller controlling the overall check-accepting apparatus. The check-accepting apparatus is provided with a display unit displaying a variety of information for the user based on control of the controller 3, and an operation unit for accepting an operation instruction from the user and notifying the controller 3, and the like.

The conveyance path C includes a first conveyance path C1, a second conveyance path C2, a third conveyance path C3, a fourth conveyance path C4, a fifth conveyance path C5, a sixth conveyance path C6, and a seventh conveyance path C7. As illustrated by a solid line in the FIG. 1, the conveyance path C connects the various parts in the casing 2, and a rotating roller, a guide that guides checks, or the like are appropriately disposed on the conveyance path C. The conveyance path C conveys checks such that a longitudinal direction of a check is the conveyance direction.

Figure 6:
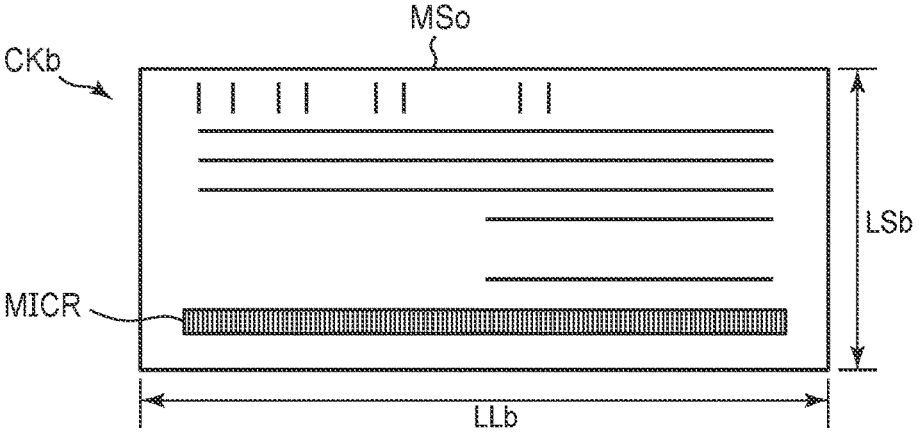
FIG. 6 is a view illustrating a configuration example of a check of maximum size.
Figure 7:
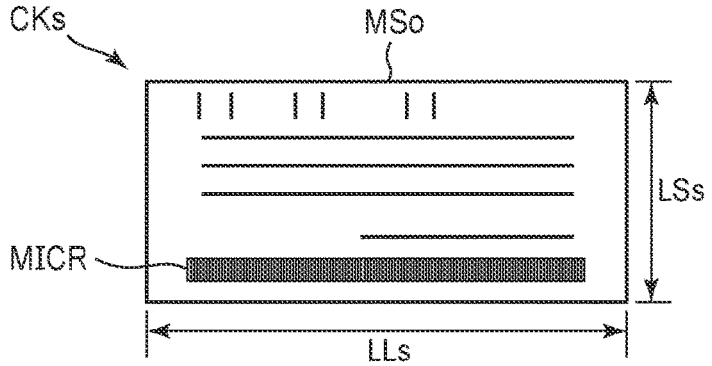
FIG. 7 is a view illustrating a configuration example of a check of minimum size.

The check processing device 1 can handle checks of different sizes. The largest sized check is illustrated in FIG. 6 as a maximum sized medium CKb (hereinafter, also referred to as a maximum sized check CKb), and the smallest sized check is illustrated in FIG. 7 as a minimum sized medium CKs (hereinafter, also referred to as a minimum sized check CKs). As illustrated in FIG. 6, the maximum sized check CKb is a rectangular paper-sheet-shaped medium having a length LLb at the long side thereof and a length LSb at the short side thereof. The long side length LLb of the maximum sized check CKb is a length in a direction parallel to the conveyance direction of the maximum sized check CKb when the maximum sized check CKb has aligned with a reference surface guide 32, and the short side length LSb of the maximum sized check CKb is a length in the width direction orthogonal to the conveyance direction when the maximum sized check CKb has aligned with the reference surface guide 32. Further, the maximum sized check CKb is printed with a magnetic character MICR, which is a character recognized using a method of Magnetic Ink Character Recognition (MICR). The magnetic character MICR is a character string unique in each check CK, and is used to identify the check CK. As illustrated in FIG. 7, the minimum sized check CKs is a rectangular paper-sheet-shaped medium having a long side length LLs of the minimum sized check CKs and a short side length LSs of the minimum sized check CKs. The minimum long side length LLs is a length in a direction parallel to the conveyance direction of the minimum sized check CKb when the minimum sized check CKs has aligned with the reference surface guide 32 and the minimum short side length LSs is a length in the width direction orthogonal to the conveyance direction when the minimum sized check CKs has aligned with the reference surface guide 32. The minimum sized check CKs is printed with a magnetic character MICR in the same manner as the maximum sized check CKb. The long side length LLb of the maximum sized check CKb, the short side length LSb of the maximum sized check CKb, the long side length LLs of the minimum sized check CKs, and the short side length LSs of the minimum sized check CKs are determined by standards (for example, a check of unified standard established by Federation of Bankers' Association of Japan). In addition, the short side length LSb of the maximum sized check CKs is set to be equal to or less than twice of the short side length LSs of the minimum sized check CKs.

The bundle unit 11 is disposed in a front half of an upper portion of the casing 2. A shutter 11S which can be opened and closed is provided at the front end of the bundle unit 11. The controller 3 controls the bundle unit 11 to open the shutter 11S when receiving an instruction to start a pay-in transaction from the user via the operation unit.

The bundle unit 11 receives checks CK stacked in a bundle shape (hereinafter, a "bundle of checks CKB") from the user, and then holds checks CK inside by closing the shutter 11S. The check CK is configured by a rectangular paper sheet with information such as an amount of money on its surface. In addition, the bundle of checks CKB is inserted into the bundle unit 11 such that the long side of each check CK is along the conveyance direction in the front-rear direction and the short side of the each check CK is along a width direction in the left-right direction. Further, the bundle of checks CKB is inserted into the bundle unit 11 with the surface on which the amount of money is written facing upward.

The bundle unit 11 includes a bundle conveyance path CB that extends along a front-rear direction by a conveyance mechanism provided inside, and conveys the bundle of checks CKB rearward along the bundle conveyance path CB. Thereby, the bundle of check CKB is caused to reach the front side of the separating unit 12 provided in the vicinity of the rear end of the bundle unit 11. The separating unit 12 separates the check CK one by one from the upper surface side of the bundle of checks CKB, and sequentially hands over the check CK to the aligner unit 13 positioned behind.

The aligner unit 13 internally includes the first conveyance path C1, which is a conveyance route that extends along the front-rear direction, and sequentially conveys the check CK received from the separating unit 12 rearward along the first conveyance path C1. At this time, the aligner unit 13 moves the check CK toward one side of a width direction in the first conveyance path C1, for example, the right side, and conveys the check CK to the second conveyance path C2 of the scanner unit 15 disposed rearward and downward.

The scanner unit 15 is positioned behind and below the aligner unit 13. The scanner unit 15 internally includes the second conveyance path C2 that extends along an up-down direction, the third conveyance path C3 that extends along the front-rear direction, the fourth conveyance path C4 that extends along the up-down direction, and a first switching unit 14.

The first switching unit 14 switches a conveyance route of the check CK based on the control of the controller 3, thereby connecting the second conveyance path C2 and the third conveyance path C3, the second conveyance path C2 and the fourth conveyance path C4, or the third conveyance path C3 and the fourth conveyance path C4. That is, the first switching unit 14 connects the second conveyance path C2 and the third conveyance path C3 when the check CK is conveyed from the aligner unit 13, thereby conveying the check CK forward. The scanner unit 15 reads the magnetic character MICR from the check CK while conveying checks CK forward along the third conveyance path C3 from the first switching unit 14, and also reads both sides (that is, front and back sides) of the check CK to generate image data, thereby conveying the check to the escrow unit 17.

The escrow unit 17 is disposed under the bundle unit 11, and includes internally a rotating drum, a tape wound around a circumferential surface of the drum, a conveyance unit for conveying checks CK, or the like. The escrow unit 17 conveys the check CK received from the scanner unit 15 to the vicinity of the circumferential surface of the drum, and sequentially winds around the circumferential surface of the drum with the tape, thereby temporarily holding checks CK. For convenience of explanation, a series of processes up to this point are called a pay-in reading process.

The controller 3 causes to display an image, characters, or the like representing the read content on the display unit, and causes to inquire whether or not to continue a pay-in transaction to the user, when all checks CK inserted in the bundle unit 11 have been read by the scanner unit 15.

If the user instructs a cancellation of the pay-in transaction, the controller 3 starts a returning process to return all checks CK held in the escrow unit 17 to the user. That is, the escrow unit 17 feeds out checks CK one by one by reversing the drum, thereby conveying checks CK to the scanner unit 15. The scanner unit 15 and the aligner unit 13 convey checks CK in order of the third conveyance path C3, the second conveyance path C2 and the first conveyance path C1, in direction opposite to the pay-in reading process, thereby sequentially conveying checks CK to the separating unit 12.

The separating unit 12 discharges the received checks CK forward, thereby being stacked checks CK in the bundle unit 11. When checks CK are discharged by the separating unit 12 and the bundle of checks CKB is formed in the bundle unit 11, the bundle unit 11 opens the shutter 11S and conveys the stacked bundle of checks CKB forward along the bundle conveyance path CB. Thereby the bundle unit 11 holds the bundle of checks CKB in a state in which the front portion of the bundle of checks CKB is exposed outside.

Herein, the bundle unit 11 monitors if the bundle of checks CKB has been taken out by an incorporated sensor. When the sensor of the bundle unit 11 detects that the bundle of checks CKB has been taken out, the controller 3 determines that the bundle of checks CKB has been returned to the user, thereby causing to close the shutter 11S and finish the returning process.

On the other hand, when the bundle of checks CKB has not been taken out within a predetermined time from the bundle unit 11, the controller 3 determines that the user has left without receiving the bundle of checks CKB and causes to start a process of taking the bundle of checks CKB into the retract unit 18. Specifically, as in the case of the pay-in reading process, the controller 3 causes to convey the bundle of checks CKB rearward by the bundle unit 11 and separate the bundle of checks CKB one by one by the separating unit 12. Hereby, the controller 3 causes to convey the separated checks to the first switching unit 14 along the first conveyance path C1 and the second conveyance path C2 by the aligner unit 13 and the scanner unit 15.

The first switching unit 14 switches the conveyance route so as to connect the second conveyance path C2 and the fourth conveyance path C4 under control of the controller 3, and conveys checks CK received from the second conveyance path C2 to the fourth conveyance path C4. The fourth conveyance path C4 is formed in the up-down direction. The fourth conveyance path C4 conveys check CK received from the first switching unit 14 downward and conveys to a second switching unit 16.

The second switching unit 16 switches the conveyance route based on the control of the controller 3, thereby connecting the fourth conveyance path C4 and the retract unit 18, or the fourth conveyance path C4 and the fifth conveyance path C5. For example, when the second switching unit 16 has switched the conveyance route so as to connect the fourth conveyance path C4 and the fifth conveyance path C5, the second switching unit 16 conveys the check CK received from the fourth conveyance path C4 to a rear conveyance unit 19.

The second switching unit 16 switches the conveyance route so as to connect the fourth conveyance path C4 and the retract unit 18 under the control of the controller 3, thereby conveying the check CK received from the scanner unit 15 to the retract unit 18. The retract unit 18 is disposed under the scanner unit 15. The retract unit 18 has a storage space for storing the check CK therein and a discharging mechanism for discharging the check CK to the storage space. The retract unit 18 sequentially discharges the check CK received from the second switching unit 16 into a discharge space by the discharging mechanism, and stores the check CK in a stacked state in the discharge space. Hereby, the controller 3 finishes the process of taking the bundle of checks CKB into the retract unit 18.

On the other hand, when the user instructs to continue the pay-in transaction in a state where all checks CK are held in the escrow unit 17 by the pay-in reading process, the controller 3 causes to start a process for storing the checks CK. Specifically, the escrow unit 17 feeds out the held checks CK one by one by reversing the drum, and conveys checks CK to the scanner unit 15.

The scanner unit 15 prints information representing a transaction result to the check CK by an incorporated printer and stamp unit while conveying the check CK rearward received sequentially from the escrow unit 17 along the third conveyance path C3, takes an image and recognizes a printing state. After that, the check CK is conveyed to the first switching unit 14.

The first switching unit 14 switches the conveyance route so as to connect the third conveyance path C3 and the fourth conveyance path C4 by the control of controller 3, thereby conveying the checks CK received from the third conveyance path C3 to the fourth conveyance path C4. The fourth conveyance path C4 conveys the checks CK received from the first switching unit 14 downward, and conveys the checks CK to the second switching unit 16.

The second switching unit 16 switches the conveyance route so as to connect the fourth conveyance path C4 and the fifth conveyance path C5 by the control of the controller 3, thereby conveying the checks CK received from the scanner 15 to the rear conveyance unit 19.

The rear conveyance unit 19 is formed with the fifth conveyance path C5 so as to connect the fourth conveyance path C4 and the sixth conveyance path C6. The rear conveyance unit 19 conveys the checks CK received from the second switching unit 16 forward and downward, and conveys the checks CK to the first stacker unit 22A disposed at the front and below of the rear conveyance unit 19. The first stacker unit 22A is attachable to and detachable from the casing 2, and includes a stacker that can store various checks CK inside and a discharging mechanism that discharges the check CK into the stacker. The first stacker unit 22A is formed with the sixth conveyance path C6 along the front-rear direction. When receiving the checks CK from the rear conveyance unit 19, the first stacker unit 22A discharges the checks CK by the discharging mechanism and stores the checks CK in the stacked state.

When storing the check CK into the second stacker unit 22B based on the control of the controller 3, the first stacker unit 22A conveys the checks CK received from the rear conveyance unit 19 to the second stacker 22B by conveying the sixth conveyance path C6. The second stacker unit 22B is configured in the same manner as the first stacker unit 22A, and includes the seventh conveyance path C7 along the front-rear direction. When receiving the checks CK from the first stacker unit 22A, the second stacker unit 22B discharges the checks CK by the discharging mechanism and stores to accumulate the checks CK.

The controller 3 causes to store all checks CK held in the escrow unit 17 to the first stacker unit 22A or the second stacker unit 22B and finishes the process of storing the checks CK. Hereby, the controller 3 completes the pay-in transaction of the checks CK with the user.

1-2. Configuration of Aligner Unit

Figure 2:
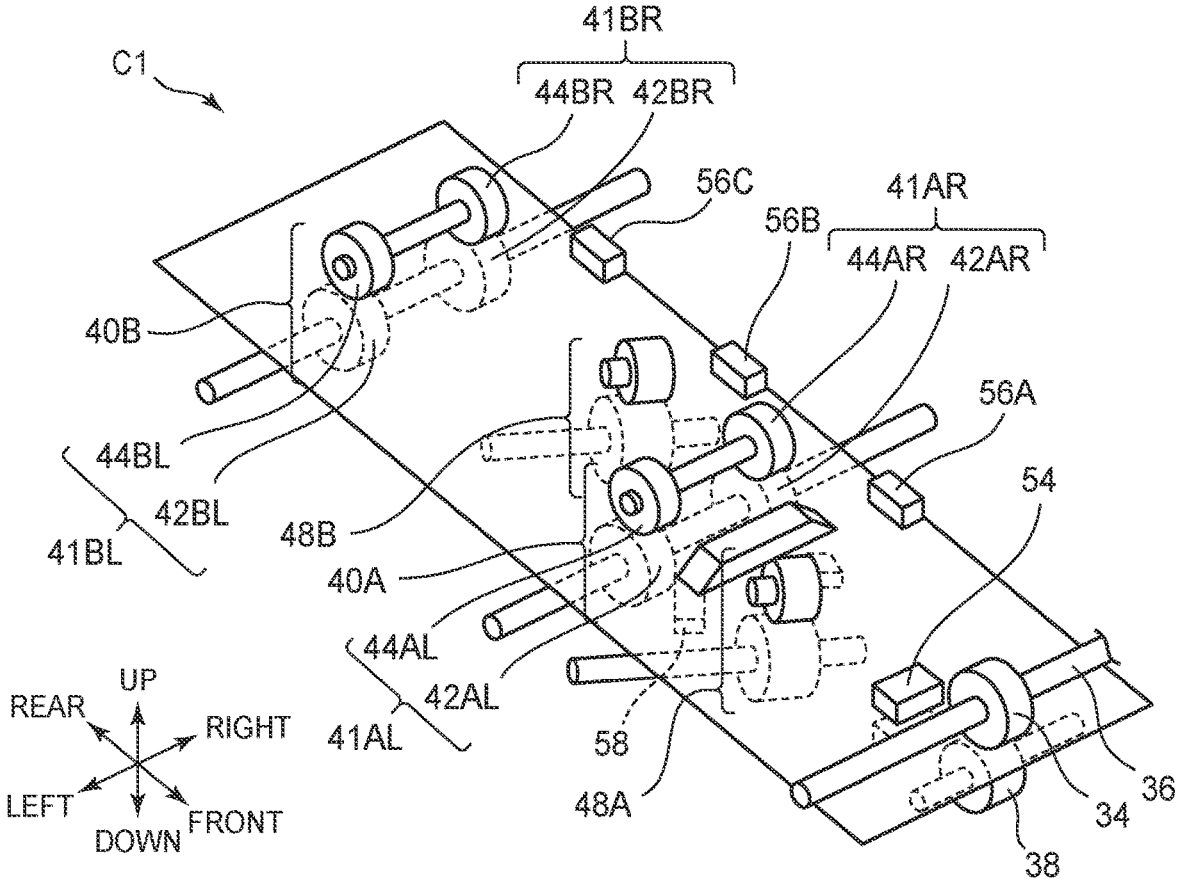
FIG. 2 is a perspective view illustrating a configuration example of an aligner unit according to a first exemplary embodiment.
Figure 3:
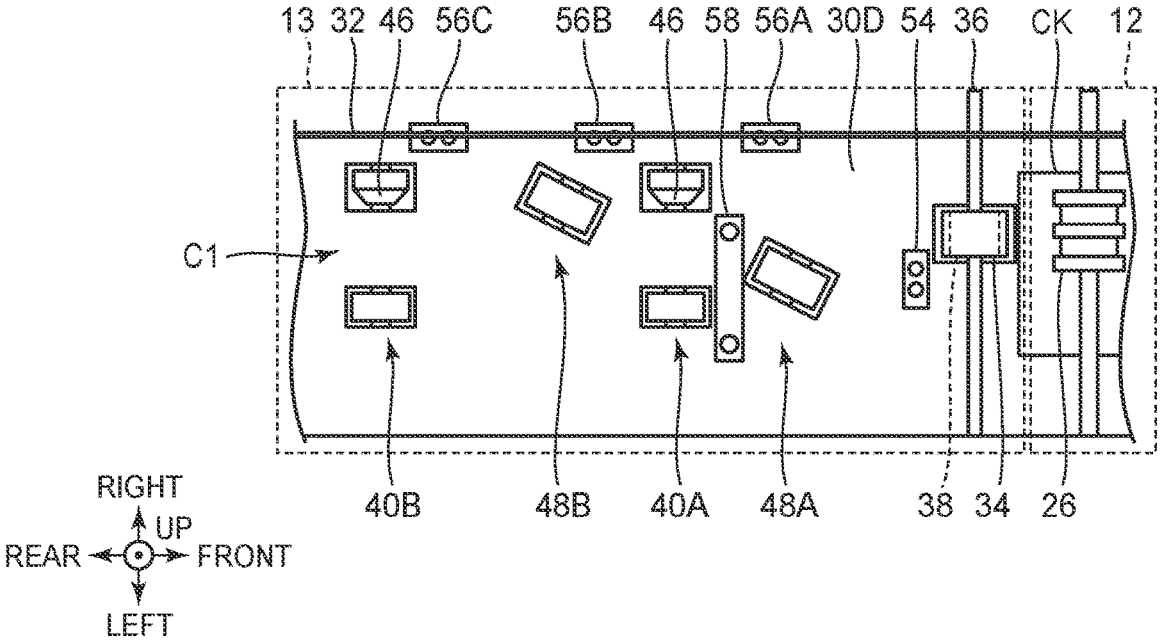
FIG. 3 is a plan view illustrating a configuration example of the aligner unit according to the first exemplary embodiment.
Figure 4:
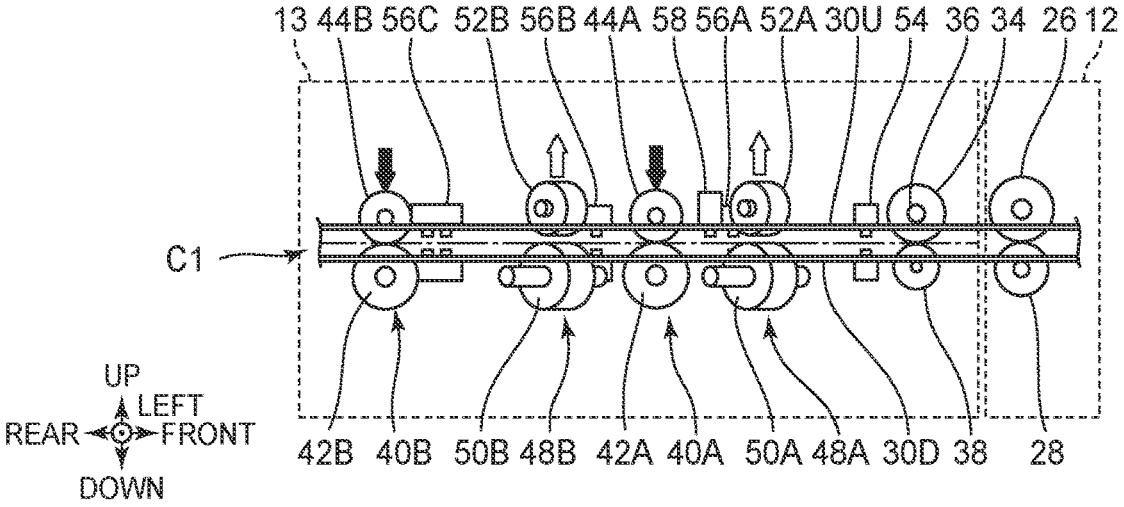
FIG. 4 is a left side view illustrating a configuration example of the aligner unit in a state in which conveyance rollers are clamped.

As illustrated in FIG. 2, FIG. 3 and FIG. 4, the aligner unit 13 is provided with an upper conveyance guide 30U, a lower conveyance guide 30D, and a reference surface guide 32. The upper conveyance guide 30U is disposed at the upper side of the first conveyance path C1, and regulates movement of the check CK in a thickness direction of the check CK. The lower conveyance guide 30D is disposed at the lower side of the first conveyance path C1, and regulates movement of the check CK in the thickness direction of the check CK. The reference surface guide 32 regulates the position of one side surface in the width direction orthogonal to the conveyance direction of the check CK. Hereinafter, the upper conveyance guide 30U and the lower conveyance guide 30D will also be collectively referred to as a conveyance guide 30. The conveyance guide 30 is provided with holes for protruding rollers attached to the conveyance guide 30 onto the first conveyance path C1. Hereinafter, a side adjacent to the reference surface guide 32 in the aligner unit 13 (that is, a right side) is also referred to as a reference surface side (a first side), and a side away from the reference surface guide 32 (that is, a left side) is also referred to as a non-reference surface side (a second side). The upper conveyance guide 30U and the lower conveyance guide 30D are not illustrated in FIG. 2, and the upper conveyance guide U is not illustrated in FIG. 3.

The first conveyance roller 34 is provided on the upper side of the first conveyance path C1 at the most upstream side of the conveyance direction in the aligner unit 13. The first conveyance roller 34 is attached to the upper conveyance guide 30U so as to be rotatable around a drive shaft 36 that extends a left-right direction. The drive shaft 36 is coupled to a feed roller 26 of the separating unit 12 by a mechanism, which is not illustrated, thereby transmitting a driving force to the feed roller 26. The first conveyance roller 34 has a part of the outer peripheral surface thereof protruded from a hole formed on the upper conveyance guide 30U to the first conveyance path C1.

A press roller 38 is provided at the lower side of the first conveyance path C1 so as to face the first conveyance roller 34. The press roller 38 is attached to the lower conveyance guide 30D. The press roller 38 is rotatable around an axis that extends the left-right direction and movable in the up-down direction. The press roller 38 has a part of the outer peripheral surface thereof protruded from a hole formed on the lower conveyance guide 30D to the first conveyance path C1. The press roller 38 is biased upward by a biasing member, which is a compression spring, and pressed against the first conveyance roller 34.

A set of conveyance rollers 40A is configured by a conveyance drive roller 42A and a conveyance press roller 44A. The conveyance drive roller 42A is configured by a conveyance drive roller 42AR positioned the right side, which is the reference surface side and a conveyance drive roller 42AL positioned the left side, which is the non-reference surface side. The conveyance press roller 44A is configured by a conveyance press roller 44AR positioned the right side, which is the reference surface side and a conveyance press roller 44AL positioned the left side, which is the non-reference surface side. Hereinafter, the conveyance drive roller 42AL and the conveyance drive roller 42AR will also be collectively referred to as the conveyance drive roller 42A, and the conveyance press roller 44AL and the conveyance press roller 44AR will also be collectively referred to as the conveyance press roller 44A. Moreover, hereinafter, the conveyance drive roller 42AL and the conveyance press roller 44AL will also be collectively referred to as a pair of conveyance rollers 41AL, and the conveyance drive roller 42AR and the conveyance press roller 44AR will also be collectively referred to as a pair of conveyance rollers 41AR.

Even if the check with the smallest width is inserted closer to the non-reference surface side, the pair of conveyance rollers 41AL and the pair of conveyance rollers 41AR are disposed such that the check can be caught by the least one pair of conveyance rollers in a range narrower than the width along the width direction of the short side length LSs of the minimum sized check CKs.

The conveyance drive roller 42A (the conveyance drive roller 42AL and the conveyance drive roller 42AR) is provided at a downstream side of the first conveyance roller 34 in the conveyance direction and the lower side of the first conveyance path C1. The conveyance drive roller 42A is rotatable around an axis that extends in the left-right direction and is attached to the lower conveyance guide 30D. The conveyance drive roller 42A has a part of the outer peripheral surface thereof protruded from a hole formed in the lower conveyance guide 30D to the first conveyance path C1.

The conveyance press roller 44A (the conveyance press roller 44AL and the conveyance press roller 44AR) is provided at the upper side of the first conveyance path C1 so as to face the conveyance drive roller 42A. The conveyance press roller 44A is attached to the upper conveyance guide 30U. The conveyance press roller 44A is rotatable around an axis that extends in the left-right direction and is movable in the up-down direction. The conveyance press roller 44A has a part of the outer peripheral surface thereof protruded from a hole formed on the upper conveyance guide 30U to the first conveyance path C1. The conveyance press roller 44A is biased downward by a biasing member, which is a compression spring, and pressed against the conveyance drive rollers 42A.

As illustrated in FIG. 3, taper guide rollers 46 are disposed in the non-reference surface side of the conveyance drive roller 42AR and the conveyance press roller 44AR. The taper guide rollers 46 have circular truncated cone shapes, and are formed with incline surfaces such that its peripheral side surfaces are expanded outward in a radial direction as it goes from the non-reference surface side toward the reference surface side. That is, the taper shapes are formed at the edge portions of the non-reference surface side of the conveyance drive roller 42AR and the conveyance press roller 44AR. Hereby, the aligner unit 13 can prevent the check CK from being caught on the set of conveyance rollers 40A when moving the check CK near the side of the reference surface guide 32.

The set of conveyance rollers 40B is disposed at a downstream of the set of conveyance rollers 40A in the conveyance direction, and spaced from the set of conveyance rollers 40A by a space shorter than the minimum long side length LLs. The set of conveyance rollers 40B is configured in the same manner as the set of conveyance rollers 40A, and includes the conveyance drive roller 42B (a conveyance drive roller 42BL and a conveyance drive roller 42BR) and the conveyance press roller 44B (a conveyance press roller 44BL and a conveyance press roller 44BR). Hereinafter, the conveyance drive roller 42BL and the conveyance press roller 44BL will also be collectively referred to as a pair of conveyance rollers 41BL, and the conveyance drive roller 42BR and the conveyance press roller 44BR will be collectively referred to as a pair of conveyance rollers 41BR. Hereinafter, the set of conveyance rollers 40A and the set of conveyance rollers 40B will also be collectively referred to as a set of conveyance rollers 40. Hereinafter, the conveyance drive roller 42A and the conveyance drive roller 42B will also be collectively referred to as a conveyance drive roller 42, and the conveyance press roller 44A and the conveyance press roller 44B will also be collectively referred to as a conveyance press rollers 44.

Figure 5:
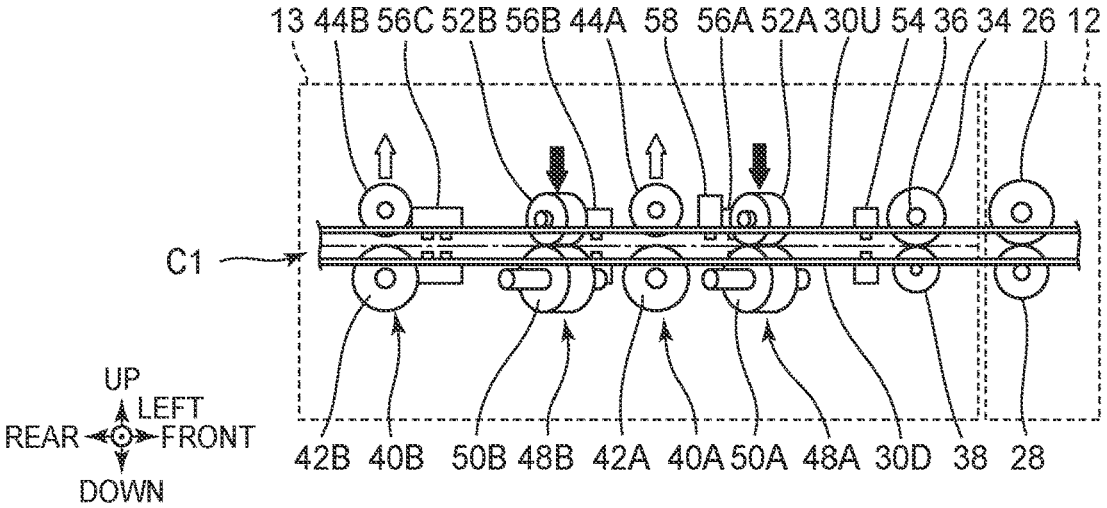
FIG. 5 is a left side view illustrating a configuration example of the aligner unit in a state in which alignment rollers are clamped.

The set of conveyance rollers 40 transitions between a conveyance roller clamped state and a conveyance roller retracted state. As illustrated in FIG. 4, the conveyance roller clamped state is a state in which the check CK is sandwiched between the conveyance press rollers 44 and the conveyance drive rollers 42 by pressing the conveyance press rollers 44 against the conveyance drive rollers 42. As illustrated in FIG. 5, the conveyance roller retracted state is a state in which a space is made between the conveyance press rollers 44 and the conveyance drive roller 42 by moving the conveyance press rollers 44 in the upward direction away from the conveyance drive rollers 42 using an actuator.

A pair of alignment rollers 48 includes a pair of alignment rollers 48A and a pair of alignment rollers 48B, and the pair of alignment rollers 48A and the pair of alignment rollers 48B are disposed along the conveyance direction. Hereinafter, the pair of alignment rollers 48A and the pair of alignment rollers 48B will also be collectively referred to as the pair of alignment rollers 48. The pair of alignment rollers 48A is provided at a position between a first sensor 54 and the set of conveyance rollers 40A in the conveyance direction. The pair of conveyance rollers 40 is not provided between the pair of alignment roller 48A and the first sensor 54.

The pair of alignment rollers 48A is configured by an alignment drive roller 50A and an alignment press roller 52A. The alignment drive roller 50A is provided below the first conveyance path C1 between the first conveyance roller 34 and the set of conveyance roller 40A. The alignment drive roller 50A is attached to the lower conveyance guide 30D so as to be rotatable around an alignment drive roller axis that extends along a rotation axis, and rotates by receiving a driving force. The alignment drive roller 50A has a part of the outer peripheral surface thereof protruded from a hole formed on the lower conveyance guide 30D to the first conveyance path C1.

The alignment press roller 52A is provided above the first conveyance path C1 so as to face the alignment drive roller 50A. The alignment press roller 52A is attached to the upper conveyance guide 30U and rotates with the alignment drive roller 50A. The alignment press roller 52A is rotatable around an alignment press roller axis parallel to the alignment drive roller axis, and movable in the up-down direction. The alignment press roller 52A has a part of the outer peripheral surface thereof protruded from a hole formed on the upper conveyance guide 30U to the first conveyance path C1. The alignment press roller 52A is biased downward by a biasing member, which is a compression spring, and pressed against the alignment drive roller 50A.

The pair of alignment rollers 48B is disposed between the set of conveyance rollers 40A and the set of conveyance rollers 40B in the conveyance direction, and is disposed at a position between the reference surface guide 32 and the pair of alignment rollers 48A in the width direction. The pair of alignment rollers 48B is configured in the same manner as the pair of alignment rollers 48A. Hereinafter, the alignment drive roller 50A and the alignment drive roller 50B will also be collectively referred to as an alignment drive roller 50, and the alignment press roller 52A and the alignment press roller 52B will also be collectively referred to as an alignment press roller 52.

The pair of alignment rollers 48 transitions between an alignment roller clamped state and an alignment roller retracted state. As illustrated in FIG. 5, the alignment roller clamped state is a state in which the check CK is sandwiched between the alignment press rollers 52 and the alignment drive roller 50 by pressing the alignment press rollers 52 against the alignment drive rollers 50. As illustrated in FIG. 4, the alignment roller retracted state is a state in which a space is made between the alignment press rollers 52 and the alignment drive roller 50 by moving the alignment press rollers 52 in the upward direction away from the alignment drive rollers 50 using an actuator. As illustrated in FIG. 4, in the case where the set of conveyance rollers 40 is in the conveyance roller clamped state, the pair of alignment rollers 48 is in the alignment roller retracted state. On the other hand, as illustrated in FIG. 5, in the case where the set of conveyance rollers 40 is in the conveyance roller retracted state, the pair of alignment rollers 48 is in the alignment roller clamped state.

1-3. Size of Conveyance Path

Figure 8:
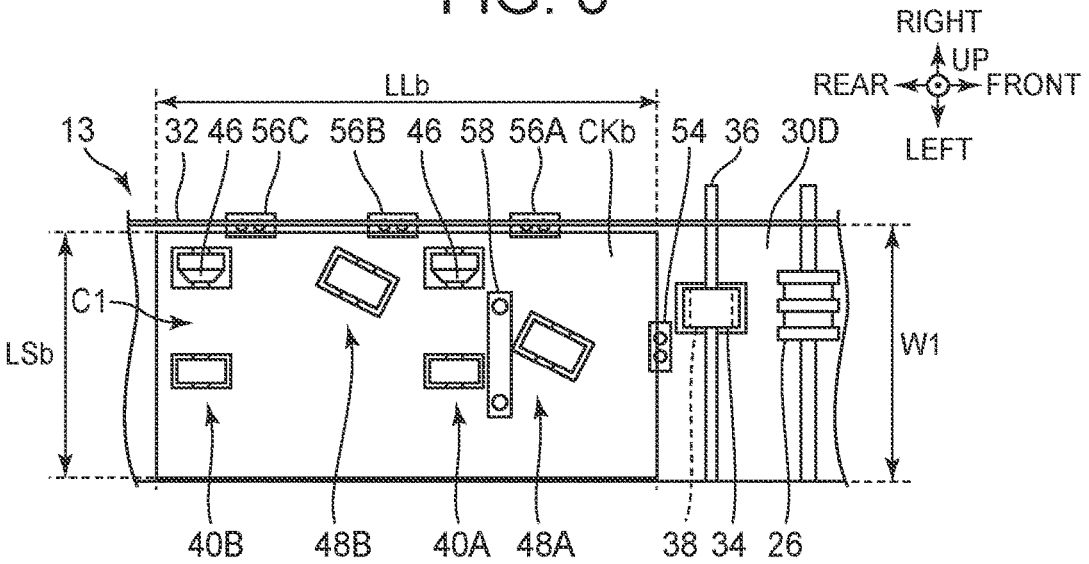
FIG. 8 is a plan view illustrating a configuration example of the aligner unit according to the first exemplary embodiment.

As illustrated in FIG. 8, a the conveyance path width W1, which is a length of a width direction orthogonal to the conveyance direction in the first conveyance path C1 is slightly larger than the short side length LSb of the maximum sized check CKb. In other words, the conveyance path width W1 is equal to or less than twice the short side length LSs of the minimum sized check CKs. A length of the aligner unit 13 in the conveyance direction is longer than the long side length LLb of the maximum sized check CKb.

1-4. Arrangement of Alignment Roller

Figure 9:
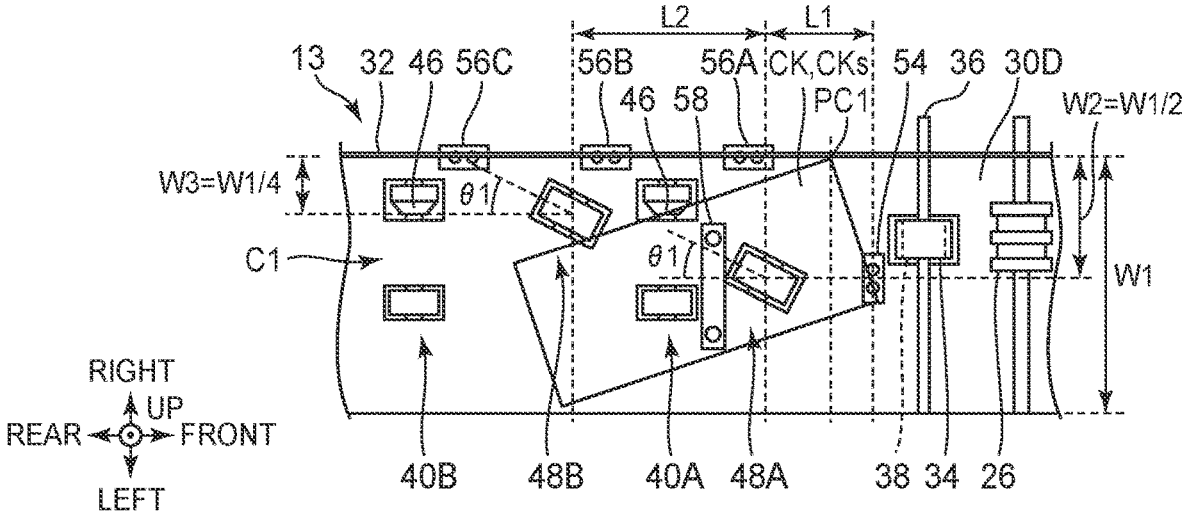
FIG. 9 is a plan view illustrating a configuration example of the aligner unit according to the first exemplary embodiment.

As illustrated in FIG. 9, the pair of alignment rollers 48 (the pair of alignment rollers 48A and the pair of alignment rollers 48B) is inclined such that an alignment roller conveyance direction which is a direction orthogonal to an alignment roller axis direction which is an axis direction of a rotation axis of the pair of alignment rollers 48 is directed toward the reference surface guide 32 at the alignment angle θ1 with respect to the conveyance direction as it goes the downstream side of the conveyance direction. Hereinafter, the pair of alignment rollers 48A and the pair of alignment rollers 48B will also be collectively referred to as the pair of alignment rollers 48.

The pair of alignment rollers 48A is disposed such that its center is away by a length of a distance W2, which is half of the conveyance path width W1 from the reference surface guide 32 along the width direction. The pair of alignment rollers 48A is disposed at the center of the conveyance path width W1 in the first conveyance path C1. Thereby, even if the minimum sized check CKs is conveyed at any position in the width direction of the aligner unit 13, the aligner unit 13 can apply the pair of alignment rollers 48A to the minimum sized check CKs.

Figure 14:
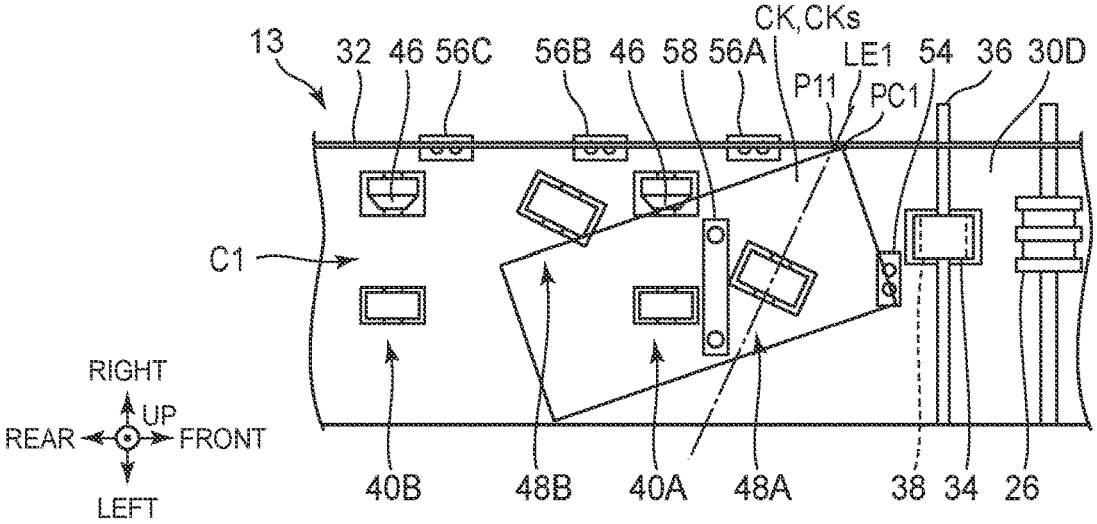
FIG. 14 is a plan view illustrating a configuration example of the aligner unit according to the first exemplary embodiment.

Further, as illustrated in FIG. 14, at a position where the minimum sized check CKs skewed with the right side preceding so that the reference surface side precedes with respect to the non-reference surface side starts to convey the minimum sized check CKs while moving the minimum sized check CKs near the reference surface guide 32, that is, at a position where the rear end of the minimum sized check CKs in the conveyance direction passes through the first sensor 54, if a point where the minimum sized check CKs abuts on the reference surface guide 32 is defined a contact point PC1 as an upstream contact point, the pair of alignment rollers 48A is positioned that its center is at the downstream side of the contact point PC1 in the conveyance direction, and is disposed at a position separated from the first sensor 54 by a distance L1 along the conveyance direction, as illustrated in FIG. 9.

As illustrated in FIG. 14, if a point where an alignment roller rotation axis extension line LE1 that extends along an alignment roller rotation axis as a rotation axis rotating the pair of alignment rollers 48A and the reference surface guide 32 intersect is defined as an intersection point PI1, the pair of alignment rollers 48A is disposed such that the intersection point Phi is positioned at a downstream side in the conveyance direction than the contact point PC1.

Figure 11:
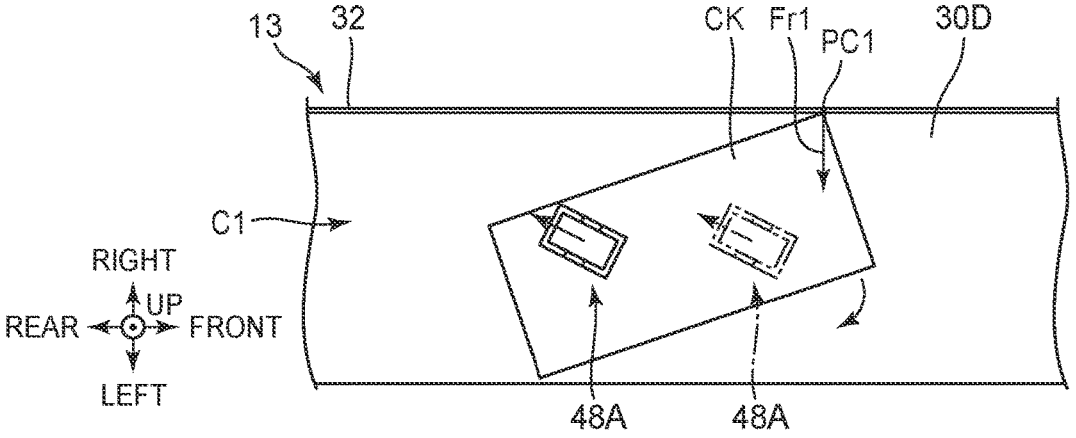
FIG. 11 is a plan view illustrating a configuration example of a virtual aligner unit.
Figure 12:
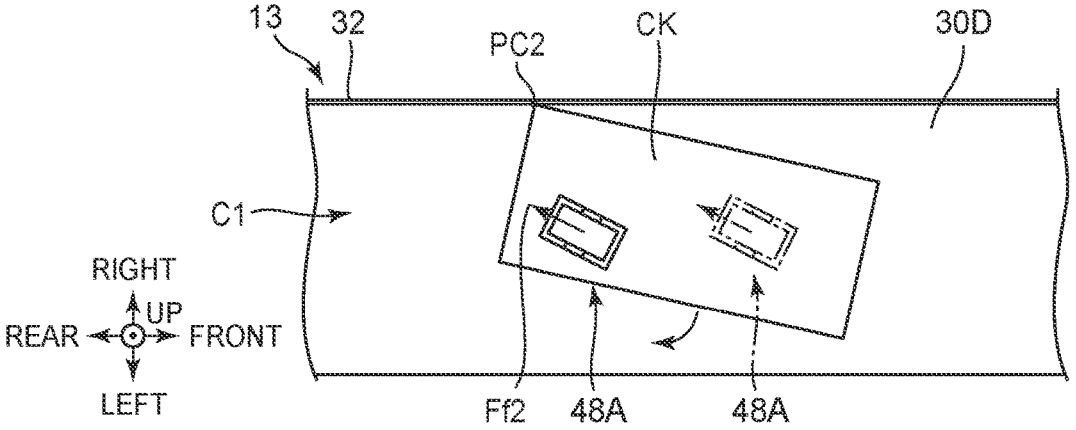
FIG. 12 is a plan view illustrating a configuration example of a virtual aligner unit.

Herein, if the distance L1 is too long, that is, if the pair of alignment rollers 48A is positioned at the downstream side of the current position in the conveyance direction, as illustrated in FIG. 11, a distance between the pair of alignment rollers 48A and the contact point PC1 becomes long. Thereby, when the skewed check CK with the right side preceding abuts on the reference surface guide 32 from the corner of the rear end of the check CK in the conveyance direction, the check CK may rotate clockwise in a plan view so as to be away the rear end of the check CK in the conveyance direction from the reference surface guide 32, by a reaction force Fr1 that the corner of the rear end of the check CK in the conveyance direction receives from the reference surface guide 32. Further, if the distance L1 is too long, as illustrated in FIG. 12, the skewed check CK with the left side preceding abuts on the reference surface guide 32 from the corner of the front end of the skewed check CK in the conveyance direction, the check CK may rotate clockwise in a plan view so as to be away the rear end of the check CK in the conveyance direction from the reference surface guide 32 using the contact point PC2 as a fulcrum, by the conveyance force Ff1 received from the pair of alignment rollers 48A. Other than the mechanism used for description is not illustrated and is omitted in FIG. 11, FIG. 12 and FIG. 13. The original pair of alignment rollers 48A is illustrated by a broken line in FIG. 11, FIG. 12 and FIG. 13.

Figure 13:
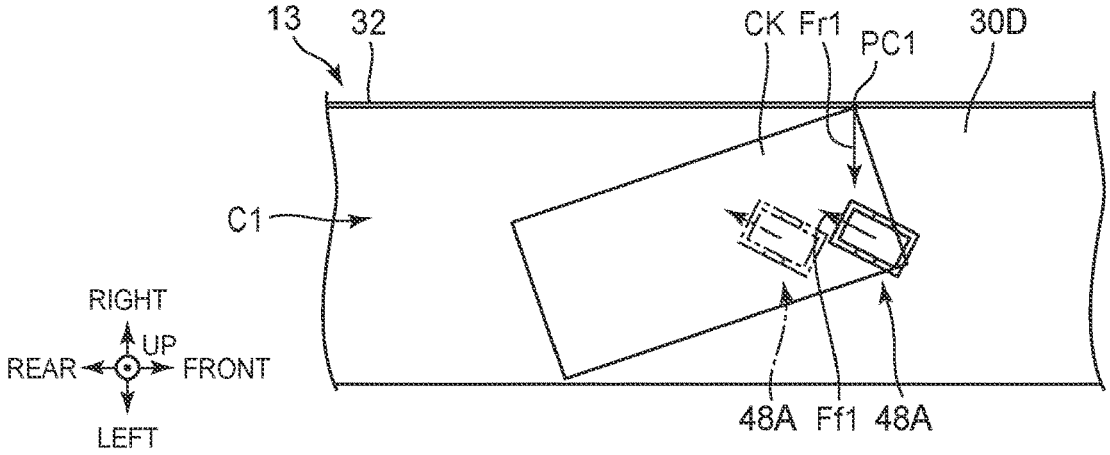
FIG. 13 is a plan view illustrating a configuration example of a virtual aligner unit.

On the other hand, as illustrated in FIG. 13, if the distance L1 is too short, that is, if the intersection point Phi is positioned at an upstream side of the contact point PC1 in the conveyance direction, and the pair of alignment rollers 48A is positioned at the upstream side of the current position in the conveyance direction, a direction of the reaction force Fr1 that the corner of the rear end of the check CK in the conveyance direction receives from the reference surface guide 32 and a direction of a conveyance force Ff1 when the pair of alignment rollers 48A conveys the check CK while moving the check CK near the reference surface guide 32 approximately face each other, and therefore the corner of the rear end of the check CK in the conveyance direction is likely to buckle, when the corner of the rear end of the check CK in the conveyance direction abuts on the reference surface guide 32.

In contrast, in the aligner unit 13, when the corner of the rear end of the check CK in the conveyance direction has abutted on the reference surface guide 32, the distance L1 is set so that the check CK does not rotate clockwise in the plan view so as to be away the rear end of the check CK in the conveyance direction from the reference surface guide 32, and therefore the corner of the rear end of the check CK in the conveyance direction does not buckle.

As illustrated in FIG. 9, the pair of alignment rollers 48B is disposed such that its center is away by a length of a distance W3, which is half of the conveyance path width W2 (that is, a quarter of the conveyance path width W1) from the reference surface guide 32 along the width direction.

Figure 10:
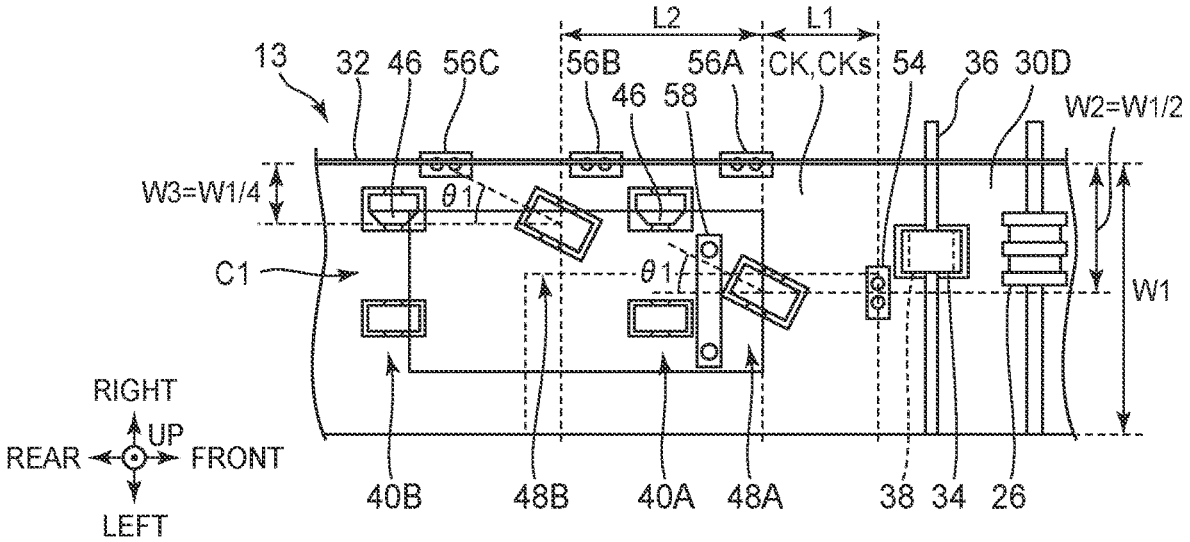
FIG. 10 is a plan view illustrating a configuration example of the aligner unit according to the first exemplary embodiment.

When the rear end of the minimum sized check CKs in the conveyance direction conveyed lopsidedly toward the non-reference surface side illustrated by a broken line in FIG. 10 passes through the first sensor 54, the aligner unit 13 starts to convey the minimum sized check CKs while moving the minimum sized check CKs near the reference surface guide 32. Thereby, the aligner unit 13 conveys the minimum sized check CKs along the alignment roller conveyance direction, which is a direction inclined in an alignment direction from the conveyance direction by the pair of alignment rollers 48A. After that, the distance W3 is set so that the end of the reference surface side of the minimum sized check CKs illustrated by a solid line in FIG. 10 reaches the center of the pair of alignment rollers 48B, when the rear end of the minimum check CKs in the conveyance direction passes through the center of the pair of alignment rollers 48A. That is, the following relationship is satisfied.

$$\text{Conveyance path width } W1/2 \geq \text{Distance } W3 \geq \text{Conveyance path width } W1 - (\text{Short side length } LSs + \text{Distance } L1 \times \tan\theta 1)$$

Herein, if the distance W3 is too long, that is, if the pair of alignment rollers 48B is positioned at the non-reference surface side from the current position, the check CK is held by the pair of alignment rollers 48B at a position separated from the reference surface guide 32. In other words, since the check CK cannot be held by the pair of alignment rollers in vicinity of the reference surface guide 32, when the check CK abuts on the reference surface guide 32, the end of the reference surface side of the check CK is likely to buckle.

On the other hand, if the distance W3 is too short, that is, if the pair of alignment rollers 48B is positioned at the reference surface side from the current position, when the check CK is inserted on the non-reference surface side in the aligner unit 13, the minimum sized check CKs may not reach the center of the pair of alignment rollers 48B when the rear end of the minimum sized CKs in the conveyance direction has passed through the center of the pair of alignment rollers 48A.

In contrast, in the aligner unit 13, the distance W3 is set so that the check CK does not buckle when the check CK has abutted on the reference surface guide 32, and the check CK that has passed through the pair of alignment rollers 48A is reliably transferred to the pair of alignment rollers 48B.

Figure 16:
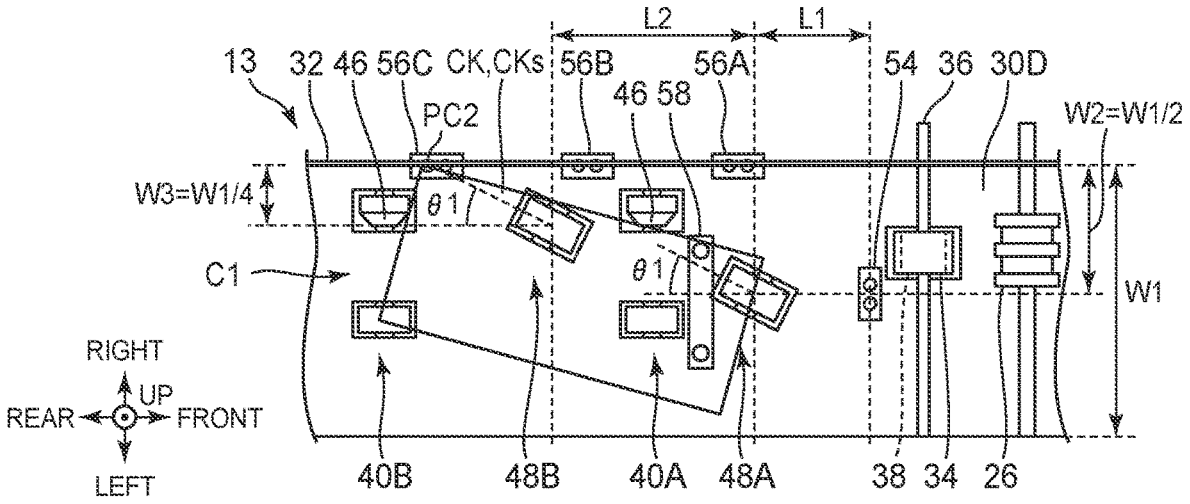
FIG. 16 is a plan view illustrating a configuration example of the aligner unit according to the first exemplary embodiment.

As illustrated in FIG. 16, at a position where the rear end the minimum sized check CKs in the conveyance direction skewed with the left side preceding passes through the pair of alignment rollers 48A, if a point where the minimum sized check CKs abuts on the reference surface guide 32 is defined a contact point PC2 as a downstream contact point, the pair of alignment rollers 48B is positioned that its center is at the upstream side of the contact point PC2 in the conveyance direction, and is disposed at a position separated from the pair of alignment rollers 48A by a distance L2 along the conveyance direction. The distance L2 is set shorter than the long side length LLs of the minimum sized check CKs.

Figure 17:
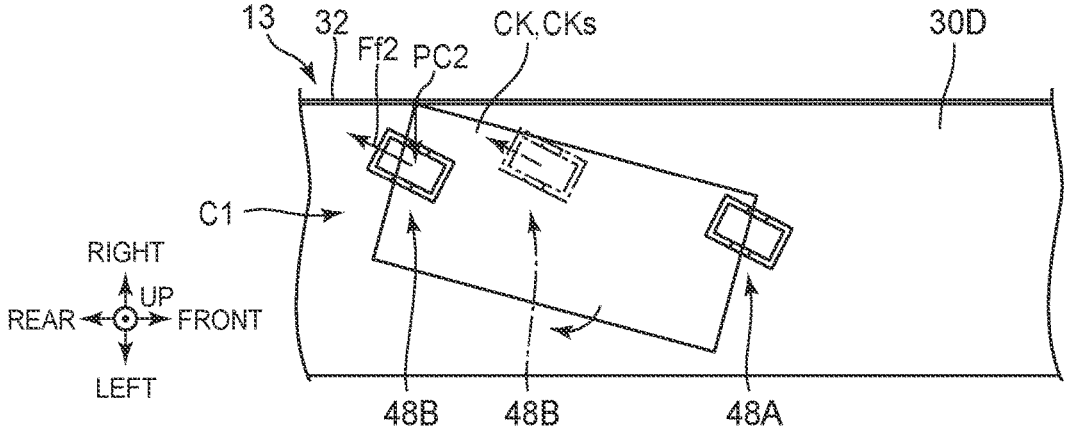
FIG. 17 is a plan view illustrating a configuration example of a virtual aligner unit.

Herein, as illustrated in FIG. 17, if the distance L2 is too long, that is, if the center of the pair of alignment rollers 48B is positioned at the downstream side of a contact point PC2 in the conveyance direction and the pair of alignment rollers 48B is positioned at the downstream side of the current position in the conveyance direction, the minimum sized check CKs is conveyed only by the pair of alignment rollers 48B after the rear end of the minimum sized check CKs has passed through the pair of alignment rollers 48A. Then, the minimum sized check CKs may rotate clockwise in plan view so as to be away the end of the minimum sized check CKs in the conveyance direction from the reference surface guide 32 around the contact point PC2 as a fulcrum, by the conveying force Ff2 received from the pair of alignment rollers 48B. Further, there is a possibility that the pair of alignment rollers 48B does not catch the minimum sized check CKs. Other than the mechanism used for description is not illustrated and is omitted in FIG. 17. The original pair of alignment rollers 48B is illustrated by a broken line in FIG. 17.

On the other hand, if the distance L2 is too short, that is, if the pair of alignment rollers 48B is positioned at the upstream side of the current position in the conveyance direction, even if the end of the check CK in the conveyance direction has passed over the pair of alignment rollers 48B, the check CK may not be completely moved near the reference surface guide 32.

In contrast, in the aligner unit 13, the distance L2 is set so that the check CK does not rotate clockwise in the plan view so as to be away the rear end of the check CK in the conveyance direction from the reference surface guide 32 when the corner of the front end of the check CK in the conveyance direction has abutted on the reference surface guide 32, and therefore the check CK is completely moved near the reference surface guide 32.

1-5. Speed of Roller

Figure 19:
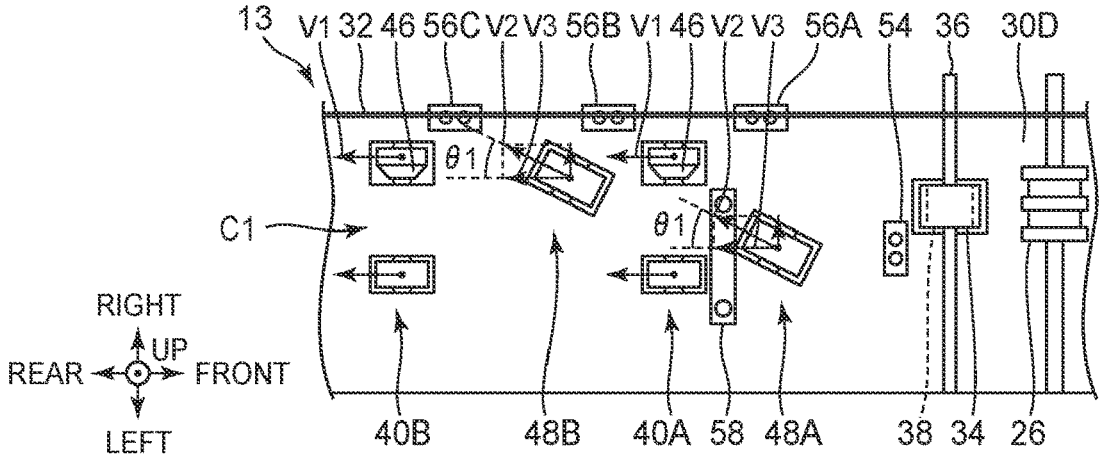
FIG. 19 is a plan view illustrating a configuration example of the aligner unit according to the first exemplary embodiment.

As illustrated in FIG. 19, the set of conveyance rollers 40 (the set of conveyance rollers 40A and the set of conveyance rollers 40B) conveys the check CK at feeding speed of the conveyance roller speed V1 (rotation speed) along the conveyance direction. Further, the pair of alignment rollers 48 (the pair of alignment rollers 48A and the pair of alignment rollers 48B) conveys the check CK while moving the check CK near the reference surface guide 32 at feeding speed of the alignment roller speed V2 that is faster than the conveyance roller speed V1 along the alignment roller conveyance direction that is a direction inclined in the alignment direction with respect to the conveyance direction. Herein, if a speed component in the conveyance direction of the alignment roller speed V2 is deemed to a conveyance speed V3 (hereinafter, a deemed conveyance speed V3), the deemed conveyance speed V3 and the conveyance roller speed V1 are substantially equal. That is, the following relationship is satisfied.

$$\text{Conveyance roller speed } V1 = \text{Deemed conveyance speed } V3 = \text{Alignment roller speed } V2 \cos \theta 1$$

Thereby, the aligner unit 13 can prevent the speed at which the check CK is conveyed from being changed, even if the roller for conveying the check CK is switched between the set of conveyance rollers 40 and the pair of alignment rollers 48.

1-6. Arrangement of Sensors

Figure 20:
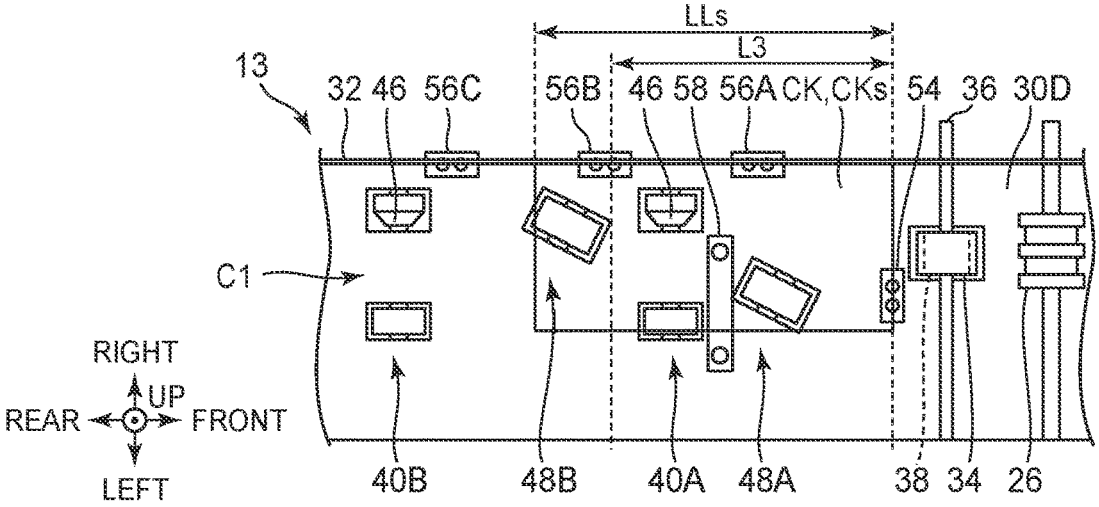
FIG. 20 is a plan view illustrating a configuration example of the aligner unit according to the first exemplary embodiment.

As illustrated in FIG. 20 and FIG. 20, the first sensor 54 is, for example, an optical sensor, and is disposed immediately downstream side of the first conveyance roller 34 in the conveyance direction. The first sensor is configured to face in the up and down across the first conveyance path C1, and detects the checks CK. The first sensor 54 is disposed at the center of the width direction in the first conveyance path C1, and detects the minimum sized check CKs regardless of where the minimum sized check CKs is conveyed in the width direction. When the first sensor 54 has detected the rear end of the inserted check CK in the conveyance direction, it is determined that the entire check CK has entered into the aligner unit 13. Thereby, the aligner unit 13 starts to move the check CK near the reference surface guide 32. That is, the first sensor 54 is used as a trigger that starts to move the check CK near the reference surface guide 32.

An alignment completion detection sensor 56A, an alignment completion detection sensor 56B, and an alignment completion detection sensor 56C are, for example, optical sensors, and are disposed in the vicinity of the reference surface guide 32 from the upstream side of the conveyance direction to the downstream side of the conveyance direction. The alignment completion detection sensor 56A is configured to face up and down across the first conveyance path C1, and detects the checks CK. The alignment completion detection sensor 56B and the alignment completion detection sensor 56C are also configured in the same manner as the alignment completion detection sensor 56A. Hereinafter, the alignment completion detection sensor 56A, the alignment completion detection sensor 56B, and the alignment completion detection sensor 56C will be collectively referred to as an alignment completion detection sensor 56.

When two or more of the three alignment completion detection sensors 56A, 56B and 56C simultaneously detect the check CK, the controller 3 determines that the check CK has been moved near the reference surface guide 32 completely. For this reason, at a position where the rear end of the minimum sized check CKs in the conveyance direction passes through the first sensor 54, the alignment completion detection sensor 56B is disposed at the upstream side with respect to a position of the front end of the minimum sized check CKs in the conveyance direction. That is, as illustrated in FIG. 20, a distance L3 from the first sensor 54 to the alignment completion detection sensor 56B in the conveyance direction is shorter than the long side length LLs of the minimum sized check CKs.

Figure 21:
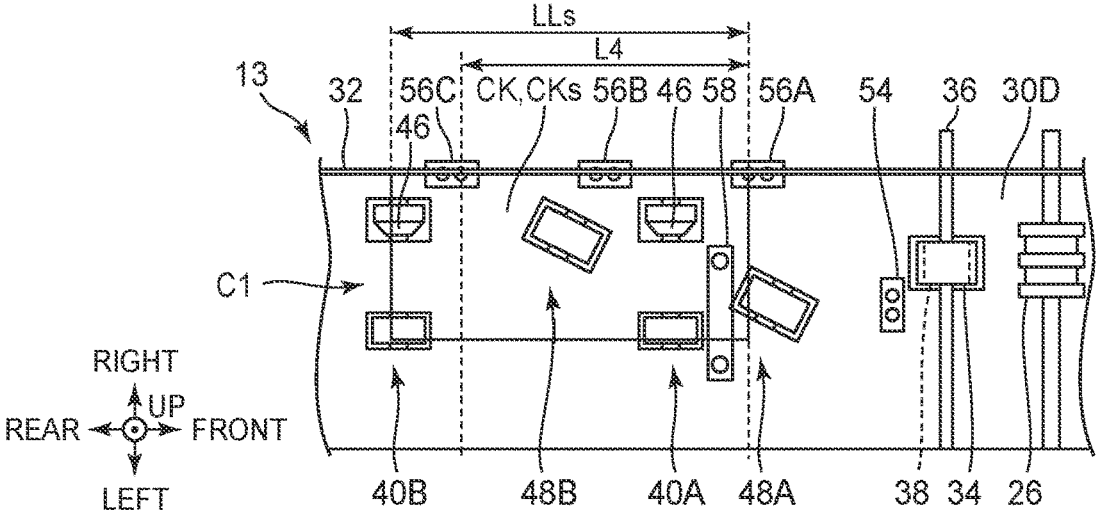
FIG. 21 is a plan view illustrating a configuration example of the aligner unit according to the first exemplary embodiment.

As illustrated in FIG. 21, at a position where the rear end of the minimum sized check CKs in the conveyance direction passes through the alignment completion detection sensor 56A, the alignment completion detection sensor 56C is disposed at the upstream side with respect to a position of the front end of the minimum sized check CKs in the conveyance direction. That is, a distance L4 from the alignment completion detection sensor 56A to the alignment completion detection sensor 56C in the conveyance direction is shorter than the long side length LLs of the minimum sized check CKs.

Thereby, the aligner unit 13 can detect that the rear end of the minimum sized check CKs in the conveyance direction has passed through the alignment completion detection sensor 56A after the check CK is completely aligned along the reference surface guide 32 by using two sensors of the alignment completion detection sensor 56A and the alignment completion detection sensor 56B. Further, the aligner unit 13 can prevent from conveying while moving the check CK near the reference surface guide 32 with respect to the inserted check CK that has already been aligned along the reference surface guide 32, and can prevent from buckling the end of the reference surface side of the check CK by being pressed against the reference surface guide 32.

Further, the alignment completion detection sensors 56 are disposed at a position where the check CK can be detected by at least two alignment completion detection sensors, when the minimum sized check CKs conveyed closest to the non-reference surface side at a position where the rear end of the minimum sized check CKs in the conveyance direction passes the first sensor 54 is conveyed to move in the alignment roller conveyance direction by the pair of alignment rollers 48 and the minimum sized check CKs abuts on the reference surface guide.

The monitoring sensor 58 is disposed between the pair of alignment rollers 48A and the set of conveyance rollers 40A in the conveyance direction and at a center of the first conveyance path C1 in the width direction. The monitoring sensor 58 is configured to face up and down across the first conveyance path C1, and detects the check CK. When the monitoring sensor 58 detects the check CK, the controller 3 determines that the check CK remains in the aligner unit 13.

1-7. Action

When the bundle of checks CKB is inserted into the bundle unit 11, the check processing device 1 causes the bundle of checks CKB to reach the front side of the separating unit 12 and feeds the check CK one by one to the aligner unit 13 by a picker press, a picker roller, the feed roller 26 (FIG. 4) and a reverse roller 28 (FIG. 4) of the separating unit 12.

As illustrated in FIG. 4, when the check CK is conveyed to the aligner unit 13, the set of conveyance rollers 40 is in the conveyance roller clamped state, and the pair of alignment rollers 48 is in the alignment roller retracted state. As illustrated in FIG. 14, when the check CK is conveyed and the rear end of the check CK in the conveyance direction is detected by the first sensor 54, the controller 3 starts to convey the check CK toward the alignment direction, which is the right side directing to the reference surface guide 32 while conveying the check CK to the downstream side in the conveyance direction by the pair of alignment rollers 48. After that, the controller 3 determines whether or not the check CK is abutted on the reference surface guide 32 and the check CK is aligned along the reference surface guide 32 by the alignment completion detection sensor 56A, the alignment completion detection sensor 56B and the alignment completion detection sensor 56C. Herein, the controller 3 determines that the operation of the check CK has been moved near the reference surface guide 32 completely, when the check CK is detected by two or more alignment completion detection sensors among the three sensors of the alignment completion detection sensor 56A the alignment completion detection sensor 56B and the alignment completion detection sensor 56C. If the controller 3 determines that the check CK has been moved near the reference surface guide 32 completely, the controller 3 causes to convey the check CK toward the downstream side in the conveyance direction.

On the other hand, as illustrated in FIG. 5, if the controller 3 has not detected that the check CK has been aligned along the reference surface guide 32 by the alignment completion detection sensor 56A, the alignment completion detection sensor 56B and the alignment completion detection sensor 56C, the set of conveyance rollers 40 is in the conveyance roller retracted state, and the pair of alignment rollers 48 is in the alignment roller clamped state. Herein, as illustrated in FIG. 19, the deemed conveyance speed V3 of the pair of alignment rollers 48 is equal to the conveyance roller speed V1 in the set of conveyance rollers 40. Thereby, even if the roller for conveying the check CK is switched from the set of conveyance rollers 40 to the pair of alignment rollers 48, the check CK is constantly conveyed in the conveyance direction at the conveyance roller speed V1.

Figure 15:
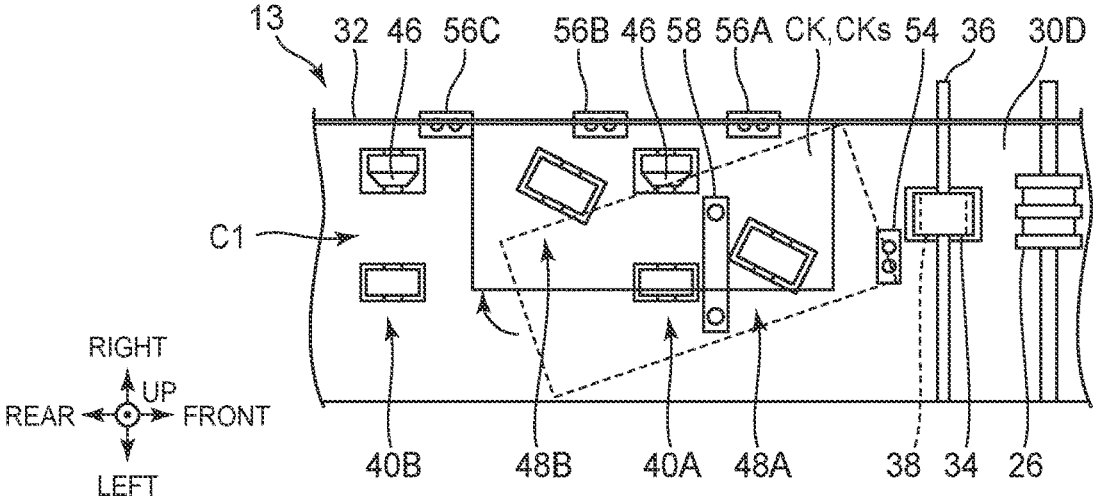
FIG. 15 is a plan view illustrating a configuration example of the aligner unit according to the first exemplary embodiment.
Figure 18:
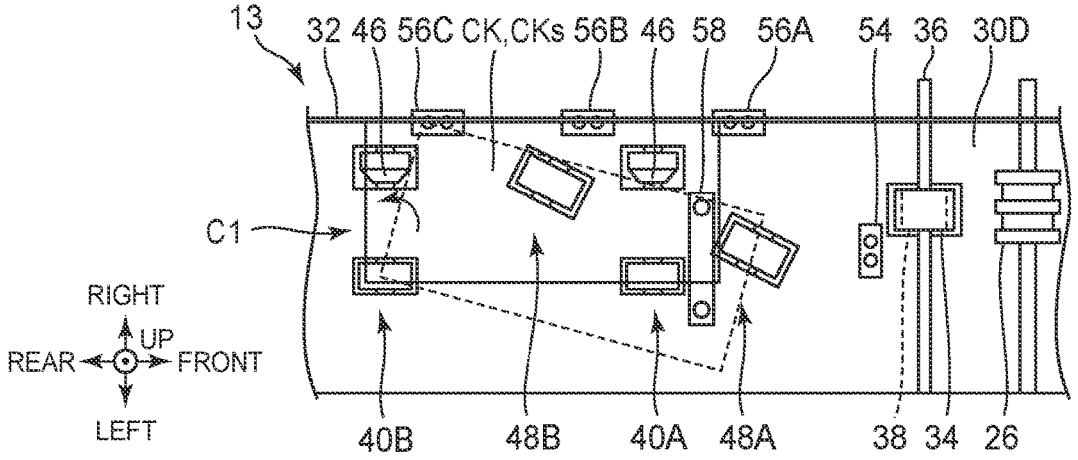
FIG. 18 is a plan view illustrating a configuration example of the aligner unit according to the first exemplary embodiment.

As illustrated in FIG. 14 and FIG. 16, when the skewed check CK is moved near the reference surface guide 32 by the pair of alignment rollers, the front end or the rear end of the check CK in the conveyance direction abuts on the reference surface guide 32. After that, as illustrated in FIG. 15 and FIG. 18, the controller 3 causes to convey the check CK so as to move the check near the reference surface guide 32 while rotating the check CK clockwise or counterclockwise in the plan view by the pair of alignment rollers 48, thereby abutting the check CK along the reference surface guide 32.

As illustrated in FIG. 4, when the controller 3 has determined that the check CK has been moved near the reference surface guide 32 by a detection result of the alignment completion detection sensors 56 completely, the conveyance roller retracted state of the set of conveyance rollers 40 switches to be in the conveyance roller clamped state, and the alignment roller clamped state of the pair of alignment rollers 48 switches to be in the alignment roller retracted state. As illustrated in FIG. 18, the check CK is conveyed along the reference surface guide 32 to the downstream side in the conveyance direction while maintaining a state where the check CK abuts on the reference surface guide 32.

1-8. Effects

In the check processing device 1 with the above-described configuration, the pair of alignment rollers 48A is disposed so as to be positioned at the downstream side of the contact point PC1 in the conveyance direction at the approximately the center of the width direction in the first conveyance path C1, and is disposed so as to be away from the first sensor 54 by the distance L1 along the conveyance direction. Further, the pair of alignment rollers 48A is disposed such that the intersection point PI1 is positioned at the downstream side of the contact point PC1 in the conveyance direction.

Further, in the check processing device 1, the pair of alignment rollers 48B is disposed so as to be positioned at the upstream side of the contact point PC2 in the conveyance direction at the approximately center in the width direction between the reference surface guide 32, and is disposed so as to be away from the pair of alignment rollers 48A by the distance L2 along the conveyance direction.

Hereby, even if checks of various sizes are inserted into the aligner unit 13 at various angles and positions, the check processing device 1 can prevent the portion that abuts on the reference surface guide 32 from buckling, and can be aligned the check CK along the reference surface guide 32 while deskewing the check CK.

Further, in the aligner unit 13, the alignment completion detection sensor 56B is disposed so as to be positioned at the upstream side of a position that the front end of the minimum sized check CKs in the conveyance direction, at a position where the rear end of the minimum sized check CKs in the conveyance direction passes through the first sensor 54. Further, in the aligner unit 13, the alignment completion detection sensor 56C detects the minimum sized check CKs by at least two alignment completion detection sensors 56 when the minimum sized check CKs conveyed toward the non-reference surface side is conveyed in the alignment roller conveyance direction and abuts on the reference surface guide 32. Further, the alignment completion detection sensor 56C is disposed at the upstream side of the front end of the minimum sized check CKs in the conveyance direction at a position where the rear end of the minimum sized check CKs in the conveyance direction passes through the alignment completion detection sensor 56A.

Thereby, even if checks of various sizes are inserted into the aligner unit 13 at various angles and positions, the check processing device 1 can reliably detect moving the check CK near the reference surface side.

Further, the aligner unit 13 is not provided with the set of conveyance rollers between the pair of alignment rollers 48A and the first sensor 54. Thereby, the aligner unit 13 can prevent from being increased the distance L1 by the amount provided with the set of conveyance rollers 40.

With the above-described configuration, the check processing device 1 is provided with the conveyance guide 30 that forms the first conveyance path C1 through which the check CK is conveyed and guides the check CK along the first conveyance path C1, the reference surface guide 32 that is provided in one side of the width direction orthogonal to the conveyance direction of the check CK and that limits a conveyance range in the width direction of the check CK, a first sensor 54 that detects the rear end of check in the conveyance direction, the pair of alignment rollers 48A disposed such that the alignment roller conveyance direction is inclined with respect to the conveyance direction, provided at the middle of the width direction in the first conveyance path C1, and that conveys to move the check CK near the reference surface guide 32, and the pair of alignment rollers 48B disposed such that the alignment roller conveyance direction orthogonal to the alignment roller axis direction that extends along the alignment roller rotation axis is inclined with respect to the conveyance direction, and that conveys to move the check CK near the reference surface guide 32, the pair of alignment rollers 48B provided at a downstream side of the conveyance direction such that the distance L2 that is a space longer than the distance L1 that is a space along the conveyance direction from the first sensor 54 to the pair of alignment rollers 48A is spaced from the pair of alignment rollers 48A, the pair of alignment rollers 48B provided between the reference surface guide 32 and the pair of alignment rollers 48A in the width direction.

When various sized checks CK is inserted into the aligner unit 13 in the skewed state, the check processing device 1 can prevent from buckling of the check's portion that abuts on the reference surface guide 32 regardless of the sizes, the inserted angle, and the position of the media, and can be aligned the check CK along the reference surface guide 32. Thus, it is possible to realize the check processing device that can improve reliability.

2. Second Exemplary Embodiment

2-1. Configuration of Check Processing Device

As illustrated in FIG. 1, as compared with the check processing device 1 according to the first exemplary embodiment, a check processing device 101 according to a second exemplary embodiment is structured similarly except for an aligner unit 113 differing from the aligner unit 13.

2-2. Configuration of Aligner Unit

Figure 22:
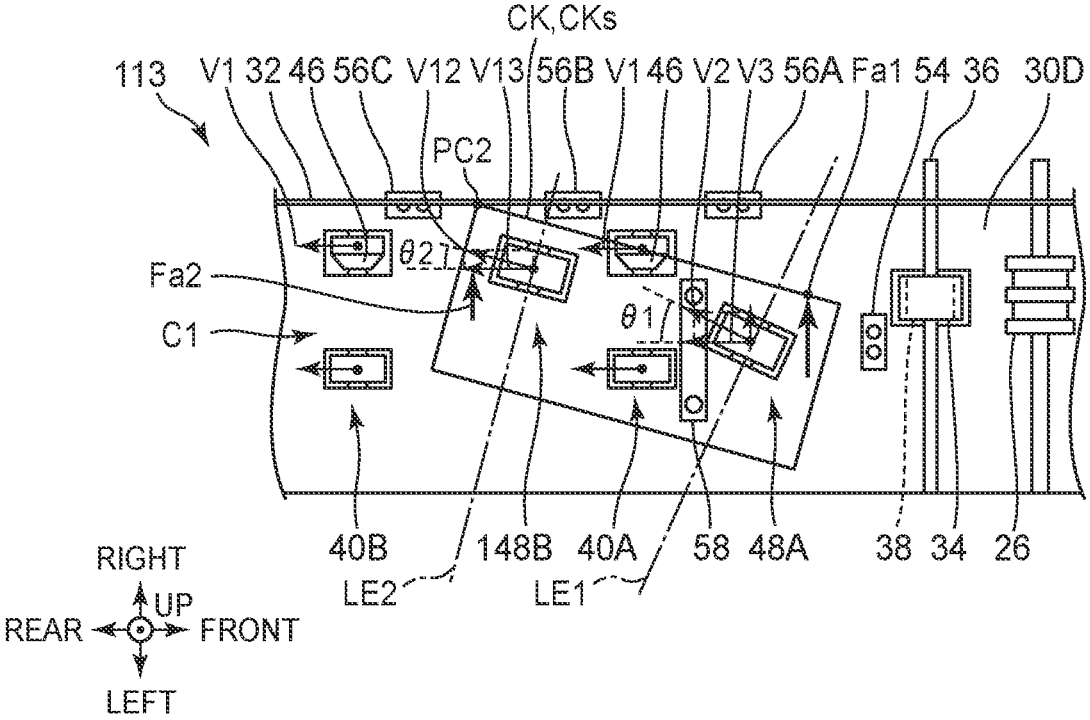
FIG. 22 is a plan view illustrating a configuration example of the aligner unit according to a second exemplary embodiment.

As illustrated in FIG. 22 with the same reference numerals given to the members corresponding to FIG. 19, as compared with the aligner unit 13 of the first exemplary embodiment, the aligner unit 113 according to the second exemplary embodiment is structured similarly except for a pair of alignment rollers 148 differing from the pair of alignment rollers 48. As compared with the pair of alignment rollers 48 according to the first exemplary embodiment, the pair of alignment rollers 148 according to the second exemplary embodiment is structured similarly except for an arrangement of the pair of alignment rollers 148B differing from the pair of alignment roller 48B.

The pair of alignment rollers 148B is inclined such that the alignment roller conveyance direction is directed toward the reference surface guide 32 at the alignment angle θ2 with respect to the conveyance direction as it goes the downstream side of the conveyance direction. The alignment angle θ2 of the pair of alignment rollers 148B is smaller than the alignment angle θ1 of the pair of alignment rollers 48B (FIG. 19).

The set of conveyance rollers 40 convey the check CK in the conveyance direction by a feeding speed of a conveyance roller speed V1. The pair of alignment rollers 48A conveys the check CK in the alignment roller conveyance direction by the feeding speed of the alignment roller speed V2 faster than the conveyance roller speed V1 so as to move the check CK near the reference surface guide 32. Herein, if a speed component in the conveyance direction of the alignment roller speed V2 is deemed to the deemed conveyance speed V3, the deemed conveyance speed V3 and the conveyance roller speed V1 are substantially equal. The pair of alignment rollers 48B conveys the check CK in the alignment roller conveyance direction by the feeding speed of the alignment roller speed V12 faster than the conveyance roller speed V1 so as to move the check CK near the reference surface guide. Herein, if a speed component in the conveyance direction of the alignment roller speed V12 is deemed to a conveyance speed V13 (hereinafter, a deemed conveyance speed V13), the deemed conveyance speed V13 and the conveyance roller speed V1 are substantially equal. That is, the following relationship is satisfied.

Conveyance roller speed $V1$=Deemed conveyance speed $V3$=alignment roller speed $V2 \cos \theta 1$=Deemed conveyance speed $V13$=Alignment roller speed $V12 \cos \theta 2$ 2-3. Actions For example, the aligner unit 113 conveys the check CK skewed with the left side preceding so as to move the check CK near the reference surface guide 32 by the pair of alignment rollers 148, thereby causing the corner of the front end of the check CK in the conveyance direction to abut against the reference surface guide 32. At this time, the aligner unit 113 conveys the check CK so as to move the check CK near the reference surface 32 by the pair of alignment rollers 48A and the pair of alignment rollers 148B.

Herein, the alignment angle θ2 of the pair of alignment rollers 148B is smaller than the alignment angle θ1 of the pair of alignment rollers 48A, and therefore the aligner unit 113 conveys the check CK while rotating counterclockwise around a point where the alignment roller rotation axis extension line LE1 extending along the alignment roller rotation axis of the pair pf alignment rollers 48A and an alignment roller rotation axis extension line LE2 extending along the alignment roller rotation axis of the pair of alignment roller 148B intersect, in plain view. Thereby, the aligner unit 113 applies an alignment force Fa1 for bringing the check CK closer to the reference surface guide 32 with respect to the rear end side of the check CK in the conveyance direction and an alignment force Fa2 smaller than the alignment force Fa1 with respect to the front end side of the check CK in the conveyance direction. As a result, the amount of movement of the check CK directed toward the reference surface guide 32 is small at the front end side of the check CK in the conveyance direction and is large at the rear end side of the check CK in the conveyance direction.

2-4. Effects

As described above, the aligner unit 113 sets the alignment angle θ2 of the pair of alignment roller 148B to be smaller than the alignment angle θ1 of the pair of alignment rollers 48A. Thereby, when the skewed check CK abutted on the reference surface guide 32, the aligner unit 113 can be rotated the check CK to the non-reference surface side such that the corner of the front end of the check CK in the conveyance direction is away from the reference surface guide 32. As compared with the aligner unit 13, the aligner unit 113 can reduce the reaction force that the check CK receives from the reference surface guide 32 when the corner of the front end of the check CK in the conveyance direction abutted on the reference surface guide 32. Moreover, the aligner unit 113 can convey the check CK move the check CK near the reference surface guide 32 while preventing the corner of the front end of the check CK in the conveyance direction from buckling. In particular, in case of the check CK skewed with the left side preceding as illustrated in FIG. 22, the aligner unit 113 can reduce that the corner of the front end of the check CK in the conveyance direction buckles at the contact point PC2.

In addition, the check processing device 101 according to the second exemplary embodiment has substantially the same effects as the check processing device 1 according to the first exemplary embodiment.

3. Others Exemplary Embodiments

In the above-described exemplary embodiments cases are described in which the transition is made between the conveyance roller clamped state and the conveyance roller retracted state by moving the conveyance press roller 44 using the actuator and the transition is made between the alignment roller clamped state and the alignment roller retracted state by moving the alignment press roller 52 using the actuator. However, the present disclosures are not limited these. For example, the conveyance force of the pair of alignment rollers 48 or the pair of alignment rollers 148 is set to be extremely small with respect to the conveyance force of the set of conveyance rollers 40 so that the check CK is not folded by the force pressed against the reference surface guide 32, and therefore the actuator may not be provided by fixing the pair of alignment rollers 48 or the pair of alignment rollers 148 so as to be always clamped.

In the above-described exemplary embodiments cases are described in which the set of conveyance rollers 40 is not provided between the pair of alignment rollers 48A and the first sensor 54. However, the present disclosures are not limited these. For example, the set of conveyance rollers 40 may be provided between the pair of alignment rollers 48A and the first sensor 54.

In the above-described exemplary embodiments cases are described in which the long side length LLb of the maximum sized check CKb is as the length of the long side along the conveyance direction in the maximum sized check CKb and the short side length LSb of the maximum sized check CKb is as the length of the short side along the width direction in the maximum sized check CKb. However, the present disclosures are not limited these. For example, the long side length LLb of the maximum sized check CKb is required to be a medium that a length in the conveyance direction is a length of the long side in the maximum sized check among checks handled in the check processing device, and the short side length LSb of the maximum sized check CKb is required to be a medium that a length in the width direction is a length of the short side in the maximum sized check among checks handled in the check processing device 1.

In the above-described exemplary embodiments cases are described in which the long side length LLs of the minimum sized check CKs is as the length of the long side along the conveyance direction in the minimum sized check CKs and the short side length LSs of the minimum sized check CKs is as the length of the short side along the width direction in the minimum sized check CKs. However, the present disclosures are not limited these. For example, the long side length LLs of the minimum sized check CKs is required to be a medium that a length in the conveyance direction is a length of the short side in the minimum sized check among checks handled in the check processing device, and the short side length LSs of the minimum sized check CKs is required to be a medium that a length in the width direction is a length of the short side in the minimum sized check among checks handled in the check processing device 1.

In the above-described exemplary embodiments cases are described in which the present disclosure is applied to the check processing device 1 and the check processing device 101 that convey the check CK with its longitudinal direction aligned with the conveyance direction. However, the present disclosure are not limited these. For example, the present disclosure may be applied to check processing devices that convey the check CK with its short direction aligned with the conveyance direction.

In the above-described first exemplary embodiment a case is described in which the two pairs of the alignment rollers 48 including the pair of alignment rollers 48A and the pair of alignment rollers 48B are disposed in the aligner unit 13. However, the present disclosure is not limited this. For example, an arbitrary number of the pair of alignment rollers may be disposed in the aligner unit 13 depending on the difference in size between the maximum sized check CKb and the minimum sized check CKs. More specifically, one pair of alignment rollers may be disposed in the aligner unit 13, or three or more pairs of alignment rollers may be disposed in the aligner unit 13. The same applies to the second exemplary embodiment.

In the above-described exemplary embodiments cases are described in which three alignment completion detection sensors 56 are disposed in the aligner unit 13 or the aligner unit 113. However, the present disclosures are not limited to these. For example, an arbitrary number of alignment completion detection sensors 56 may be disposed in the aligner unit 13 or the aligner unit 113 depending on the difference in size between the maximum sized check CKb and the minimum sized check CKs. More specifically, two alignment completion detection sensors 56 may be disposed in the aligner unit 13 or the aligner unit 113, or four or more alignment completion detection sensors 56 may be disposed in the aligner unit 13 or the aligner unit 113.

In the above-described exemplary embodiments cases are described in which the present disclosure is applied to the check processing device 1 or the check processing device 101 that process the check CK. However, the present disclosures are not limited to these. For example, the present disclosure may be applied to various devices processing paper-sheet-shaped media such as banknotes, printing papers, gift certificates, cards, securities, or various tickets.

In the above-described exemplary embodiments cases are described in which the aligner unit 13 or the aligner unit 113 as the medium processing device is configured by the reference surface guide 32 as the reference surface guide, the first sensor 54 as the trigger sensor, the pair of alignment rollers 48A as the first alignment roller, and the pair of alignment rollers 48B or the pair of alignment rollers 148B as the second alignment roller. However, the present disclosures are not limited to these. For example, the medium processing device may be configured by a conveyance guide, a reference surface guide, a trigger sensor, a first alignment roller and a second alignment roller, having various other elements.

INDUSTRIAL APPLICABILITY

The present disclosure may also be used, for example, in an apparatus for correcting the skew of the medium while moving the medium near the reference side.

The invention claimed is:

1. A medium processing device, comprising:

a conveyance guide that forms a conveyance path through which a medium is conveyable, and that guides the medium along the conveyance path in a conveyance direction;

a reference surface guide that is provided at one side of the conveyance path, and that limits a conveyance range of the conveyance path in a width direction which is orthogonal to the conveyance direction of the medium;

a trigger sensor that detects a rear end of the medium in the conveyance direction; and a first alignment roller and a second alignment roller for aligning the medium with the reference surface guide, each of the first and second alignment rollers being so disposed that an axis direction that extends along a rotation axis thereof is inclined with respect to the conveyance direction, wherein the first alignment roller is provided at the middle, in a width of the conveyance path, and the second alignment roller is provided between the reference surface guide and the first alignment roller in the width direction, the second alignment roller is provided at a downstream side of the first alignment roller in the conveyance direction, a space from the first alignment roller to the second alignment roller in the conveyance direction is longer than a space from the trigger sensor to the first alignment roller in the conveyance direction, a width of the conveyance path in the width direction is not more than twice of a width of a minimum sized medium in the width direction, the width of the minimum sized medium being a shortest width in the width direction of all media to be handled in the medium processing device, the minimum sized medium is of a rectangular shape, and has a first side and a second side that are parallel to each other and that are along the conveyance direction when the minimum sized medium is aligned with the reference surface guide, the first side being closer to the reference surface guide than the second side, when the minimum sized medium is not aligned with the reference surface guide and an upstream end of the first side is closer to the reference surface guide than a downstream end of the first side, the first side abuts on the reference surface guide at an upstream contact point, the first alignment roller is disposed at the downstream side in the conveyance direction with respect to the upstream contact point, such that the minimum sized medium comes into contact with the reference surface guide when the trigger sensor has detected the rear end of the minimum sized medium, and the first alignment roller is disposed such that an intersection point of an extension line that extends along the rotation axis of the first alignment roller and the reference surface guide is positioned at the downstream side in the conveyance direction with respect to the upstream contact point.

2. The medium processing device of claim 1, wherein the second alignment roller is disposed at approximately a center between the reference surface guide and the first alignment roller in the width direction.

3. The medium processing device of claim 2, wherein when the minimum sized medium is not aligned with the reference surface guide and the downstream end of the first side is closer to the reference surface guide than the upstream end of the first side, the first side abuts on the reference surface guide at an downstream contact point, the second alignment roller is disposed at an upstream side in the conveyance direction with respect to the downstream contact point, such that the minimum sized medium comes into contact with the reference surface guide when the rear end of the minimum sized medium passes through the first alignment roller.

4. The medium processing device of claim 1, further comprising a conveyance roller conveying the medium in the conveyance direction, wherein a feeding speed of each of the first and second alignment rollers is faster than a feeding speed of the conveyance roller.

5. The medium processing device of claim 4, wherein, if the feeding speed of each of the first and second alignment rollers is divided into a feeding speed component in the conveyance direction and a feeding speed component in the width direction, the feeding speed in the conveyance direction of each of the first and second alignment roller is approximately equal to the feeding speed of the conveyance roller.

6. The medium processing device of claim 1, further comprising a detection sensor that is disposed in a vicinity of the reference surface guide, and that detects whether the medium has abutted on the reference surface guide.

7. The medium processing device of claim 6, wherein the detection sensor includes two or more detection sensors, and the two or more detection sensors are disposed so as to detect whether the minimum sized medium has aligned along the reference surface guide, the minimum sized medium having a shortest length in the conveyance direction of all media to be handled in the medium processing device.

8. The medium processing device of claim 7, wherein the two or more detection sensors include a first detection sensor and a second detection sensor, and a space between the first detection sensor and the second detection sensor is shorter than the length of the minimum sized medium in the conveyance direction.

9. The medium processing device of claim 6, wherein the detection sensor includes at least two detection sensors, and the at least two detection sensors are disposed so as to detect whether the minimum sized medium, which is conveyed from a position in the width direction farthest from the reference surface guide by the first and second alignment rollers when the minimum sized medium passes through the trigger sensor, has abutted on the reference surface guide.

10. The medium processing device of claim 1, wherein a first angle between a first alignment conveyance direction that is orthogonal to the axis direction that extends along the rotation axis of the first alignment roller and the conveyance direction is smaller than a second angle between a second alignment conveyance direction that is orthogonal to the axis direction that extends along the rotation axis of the second alignment roller and the conveyance direction.

11. The medium processing device of claim 1, wherein the first alignment roller and the second alignment roller are configured to sandwich the medium.

12. The medium processing device of claim 1, wherein a conveyance roller that conveys the medium in the conveyance direction is disposed outside a portion of the conveyance path that is between the first alignment roller and the trigger sensor.

* * * * *